US006225017B1

(12) United States Patent
Sato et al.

(10) Patent No.: US 6,225,017 B1
(45) Date of Patent: May 1, 2001

(54) ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

(75) Inventors: Kazuma Sato, Tokyo; Hajime Miyazaki, Yokohama; Hiroyuki Ohmori, Mishima; Hideaki Nagasaka, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/178,882

(22) Filed: Oct. 27, 1998

(30) Foreign Application Priority Data

Oct. 31, 1997 (JP) ..... 9-314677
Oct. 31, 1997 (JP) ..... 9-314678

(51) Int. Cl.[7] ..... G03G 15/09
(52) U.S. Cl. ..... 430/83; 399/111; 399/159
(58) Field of Search ..... 430/83; 399/111, 399/159

(56) References Cited

U.S. PATENT DOCUMENTS 2,297,691 10/1942 Carlson ..... 95/5
5,567,557 * 10/1996 Mori ..... 430/58.05
5,789,484 * 8/1998 Kan et al. ..... 525/98
5,826,142 * 10/1998 Takahashi et al. ..... 399/159

FOREIGN PATENT DOCUMENTS 195 05 908 8/1995 (DE) .
552740 7/1993 (EP) .
686878 12/1995 (EP) .
2265022 9/1993 (GB) .
42-23910 11/1967 (JP) .
43-24748 10/1968 (JP) .
1-230053 12/1989 (JP) .

* cited by examiner

*Primary Examiner*—Mark Chapman
(74) *Attorney, Agent, or Firm*—Fitzpatrick, Cella, Harper & Scinto

(57) ABSTRACT

An electrophotographic photosensitive member has a support and a photosensitive layer provided on the support. The photosensitive layer contains a compound which is represented by the following Formula (1):

(1)

wherein $R_1$ represents an alkyl group or an alkenyl group, $R_2$, $R_3$, $R_4$ and $R_5$ are the same or different and each represent a hydrogen atom, an alkyl group or an alkenyl group, and $X_1$ and $X_2$ are the same or different and each represent a hydrogen atom, an alkyl group, an alkenyl group or an acryloyl group, provided that $X_1$ and $X_2$ are not hydrogen atoms at the same time.

10 Claims, 1 Drawing Sheet

FIGURE
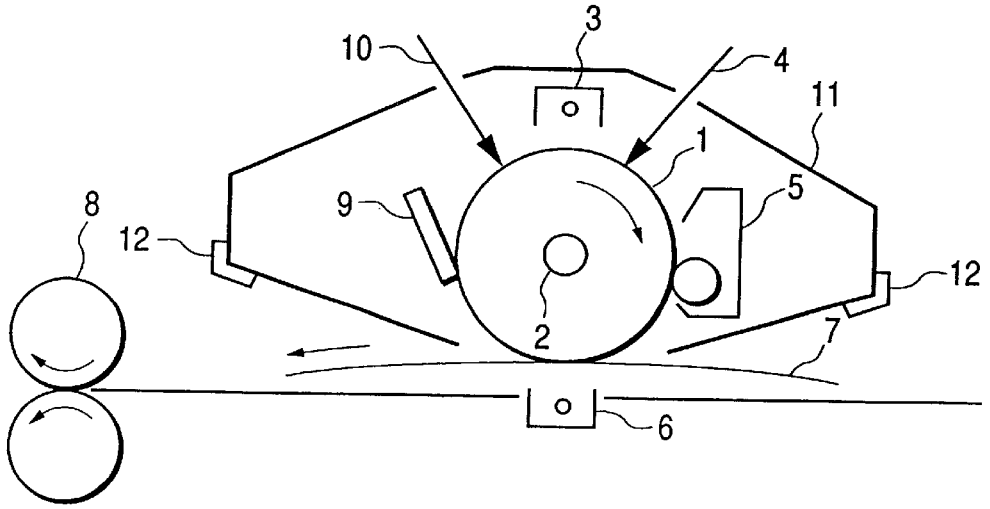

ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

A number of methods as disclosed in U.S. Pat. No. 2,297,691 and Japanese Patent Publications No. 42-23910 and No. 43-24748 are conventionally known as electrophotography. In general, copies are obtained by forming an electrostatic latent image on a photosensitive member by utilizing a photoconductive material and by various means, subsequently developing the latent image by the use of a developer (hereinafter "toner"), and transferring the toner as a toner image to a transfer medium such as paper as occasion calls, followed by fixing by means of a heat roller or the like.

The step of forming an electrostatic latent image in this electrophotographic process is, stated in greater detail, a step where a photosensitive member surface constituted of a-Se, a-Si or an organic photoconductive material is charged uniformly by corona charging, or contact charging making use of a conductive roller, and thereafter an optical image of a copying original or a dot pattern formed by the action of laser light is exposed to form the electrostatic latent image. In this charging step, active substances such as ozone and $NO_x$ are known to be generated. Also, in some cases, active substances such as ions are contained in transfer mediums such as paper.

However, the ozone and $NO_x$ generated in the above step and the active substances contained in transfer mediums may act on the photosensitive member to cause a variation of potential and an increase in residual potential, and may adversely affect electrophotographic performance and images to cause, e.g., unfocused images and smeared images and cause a lowering of running performance of the photosensitive member. In particular, organic material photosensitive members have a low resistance to ozone and $NO_x$ and moreover are often used under negative charging, which is causative of ozone in a large quantity. Thus, the generation of ozone and $NO_x$ is a great problem. Also, the active substances contained in transfer mediums may cause poor development.

To solve such problems, proposals are made on methods such that (1) a fan is provided in the machine body to exhaust any problem-causing substances, (2) a process is introduced by which any deteriorated portions of the photosensitive member surface can always be removed, (3) organic photoconductive materials resistant to the active substances as stated above are selected and (4) an antioxidant or an anti-deterioration agent is added in the photosensitive member. However, the method (1) has a problem on exhaustion efficiency; (2), a problem on mechanical durability of the photosensitive member; and (3) and (4), a problem of a difficulty in achieving both the durability to active substances and the performance of the photosensitive member.

SUMMARY OF THE INVENTION

An object of the present invention is to provide an electrophotographic photosensitive member that has solved the above problems, can prevent the photosensitive member from any deterioration caused by various active substances and also may cause no difficulty in electrophotographic performances.

Another object of the present invention is to provide an electrophotographic photosensitive member that can always maintain high-quality images free of unfocused images or smeared images even when used repeatedly and have a high potential stability.

Still another object of the present invention is to provide a process cartridge and an electrophotographic apparatus which employ such an electrophotographic photosensitive member.

That is, the present invention provides an electrophotographic photosensitive member comprising a support and a photosensitive layer provided on the support;

the photosensitive layer containing a compound which is represented by the following Formula (1):

(1)

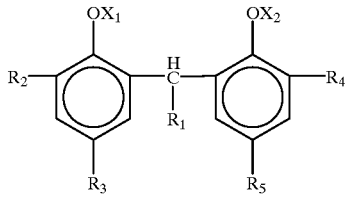

wherein $R_1$ represents an alkyl group or an alkenyl group; $R_2$, $R_3$, $R_4$ and $R_5$ are the same or different and each represent a hydrogen atom, an alkyl group or an alkenyl group; and $X_1$ and $X_2$ are the same or different and each represent a hydrogen atom, an alkyl group, an alkenyl group or an acryloyl group, provided that $X_1$ and $X_2$ are not hydrogen atoms at the same time.

The present invention also provides a process cartridge and an electrophotographic apparatus which have the electrophotographic photosensitive member described above.

BRIEF DESCRIPTION OF THE DRAWING

FIGURE schematically illustrates an example of the construction of an electrophotographic apparatus having a process cartridge having the electrophotographic photosensitive member of the present invention.

DESCRIPTION OF THE PREFERRED EMBODIMENTS

The electrophotographic photosensitive member of the present invention has a photosensitive layer on a support, and the photosensitive layer contains a compound represented by the following Formula (1):

(1)

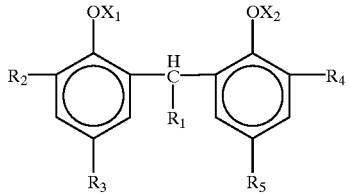

wherein $R_1$ represents an alkyl group or an alkenyl group; $R_2$, $R_3$, $R_4$ and $R_5$ are the same or different and each represent a hydrogen atom, an alkyl group or an alkenyl group; and $X_1$ and $X_2$ are the same or different and each represent a hydrogen atom, an alkyl group, an alkenyl group or an acryloyl group, provided that $X_1$ and $X_2$ are not hydrogen atoms at the same time.

The alkyl group represented by $R_1$ in Formula (1) may include a methyl group, an ethyl group and a propyl group, and may preferably have 1 to 10, and particularly 1 to 5, carbon atoms. The alkenyl group represented by $R_1$ may include a vinyl group, an allyl group and a propenyl group, and may preferably have 2 to 10, and particularly 2 to 5, carbon atoms.

The alkyl group represented by $R_2$ to $R_5$ may include a methyl group, an ethyl group and a propyl group, and may preferably have 1 to 10, and particularly 2 to 8, carbon atoms. The alkenyl group represented by $R_2$ to $R_5$ may include a vinyl group, an allyl group and a propenyl group, and may preferably have 2 to 10, and particularly 2 to 6, carbon atoms.

The alkyl group represented by $X_1$ and $X_2$ may include a methyl group, an ethyl group and a propyl group, and may preferably have 1 to 10, and particularly 1 to 5, carbon atoms. The alkenyl group represented by $X_1$ and $X_2$ may include a vinyl group, an allyl group and a propenyl group, and may preferably have 2 to 10, and particularly 2 to 5, carbon atoms. The acryloyl group represented by $X_1$ and $X_2$ may include an acryloyl group, a methacryloyl group and an ethacryloyl group. In the present invention, at least one of $X_1$ and $X_2$ may preferably be an acryloyl group, and particularly one of $X_1$ and $X_2$ may be an acryloyl group and another may be a hydrogen atom.

These groups may each have a substituent. The substituent may include alkyl groups such as methyl, ethyl and propyl, alkoxyl groups such as methoxyl, ethoxyl and propoxyl, aryl groups such as phenyl and naphthyl, and halogen atoms such as a fluorine atom, a chlorine atom and a bromine atom.

In the present invention, in addition to the compound represented by Formula (1), the photosensitive layer may preferably further contain a phosphorus compound represented by the following Formula (2), in view of an advantage that the present invention can be more remarkably effective:

(2)

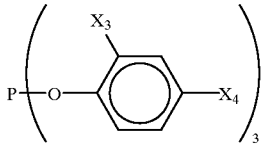

wherein $X_3$ and $X_4$ represents an alkyl group or an alkenyl group.

In the compound represented by Formula (2), the alkyl group may include a methyl group, an ethyl group and a propyl group, and may preferably have 1 to 10, and particularly 1 to 5, carbon atoms. The alkenyl group may include a vinyl group, an allyl group and a propenyl group, and may preferably have 2 to 10, and particularly 2 to 5, carbon atoms.

These groups may each have a substituent. The substituent may include alkyl groups such as methyl, ethyl and propyl, alkoxyl groups such as methoxyl, ethoxyl and propoxyl, aryl groups such as phenyl and naphthyl, and halogen atoms such as a fluorine atom, a chlorine atom and a bromine atom.

The compound represented by Formula (1) may specifically include examples of the following compounds.

Exemplary Compound (1)-1

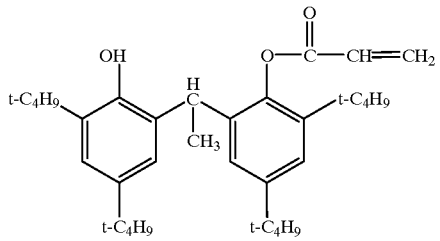

Exemplary Compound (1)-2

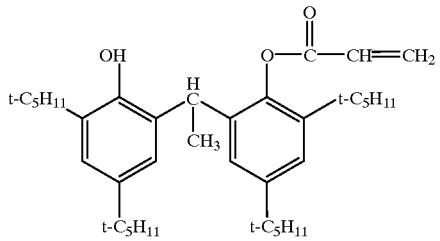

Exemplary Compound (1)-3

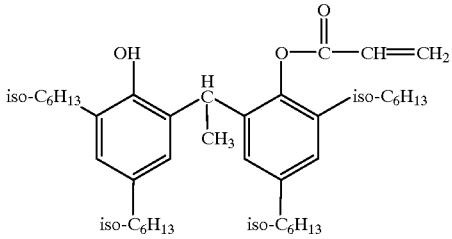

Exemplary Compound (1)-4

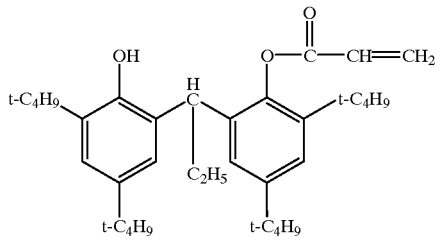

Exemplary Compound (1)-5

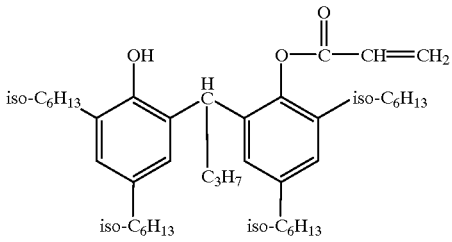

-continued

Exemplary Compound (1)-6

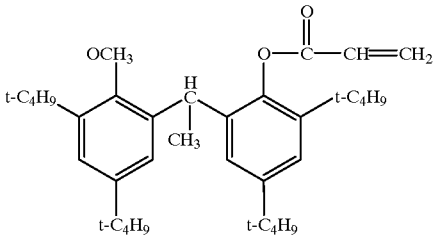

Exemplary Compound (1)-7

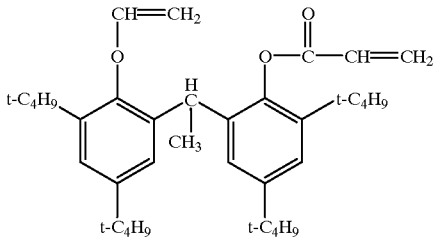

Exemplary Compound (1)-8

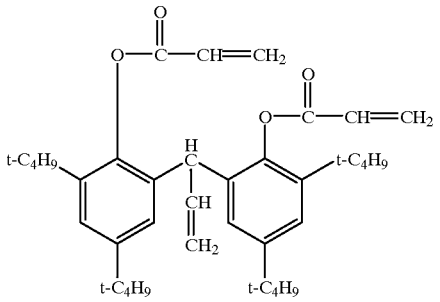

Exemplary Compound (1)-9

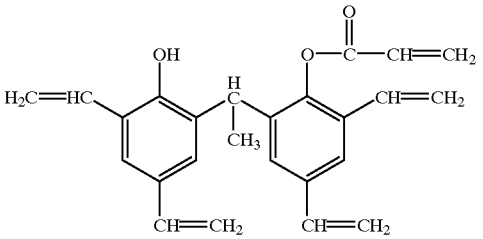

Exemplary Compound (1)-10

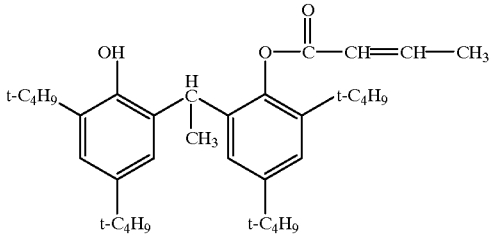

-continued

Exemplary Compound (1)-11

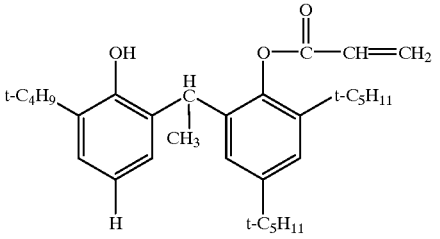

Among them, particularly, the compound represented by Formula (1)-2 may be preferable.

The compound represented by Formula (1) may preferably be added in an amount within the range of from 0.2 to 20% by weight, and particularly preferably from 0.3 to 17% by weight, based on the total weight of the photosensitive layer to which the compound is added. If it is added in an amount less than 0.2% by weight, its addition may be less effective. If it is added in an amount more than 20% by weight, a difficulty such as a decrease in sensitivity and an increase in residual potential tends to occur.

The compound represented by Formula (2) may specifically include examples of the following compounds.

Exemplary Compound (2)-1

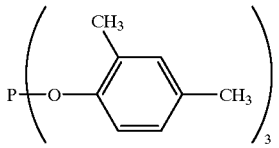

Exemplary Compound (2)-2

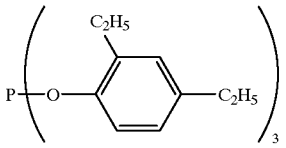

Exemplary Compound (2)-3

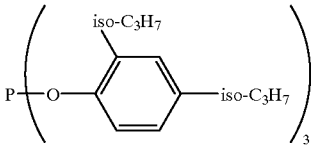

Exemplary Compound (2)-4

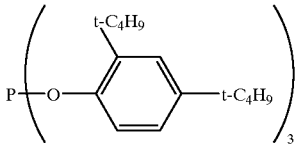

Exemplary Compound (2)-5

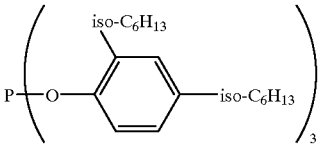

-continued

Exemplary Compound (2)-6

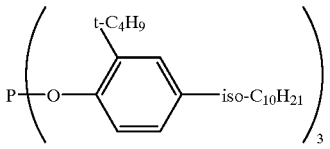

Exemplary Compound (2)-7

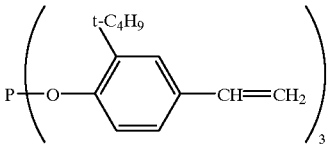

Exemplary Compound (2)-8

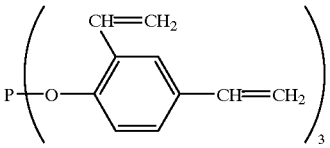

Exemplary Compound (2)-9

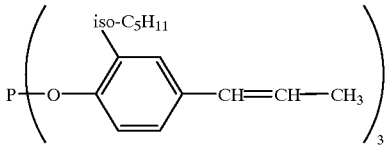

Exemplary Compound (2)-10

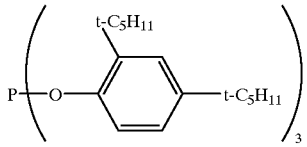

Among them, particularly, the compound represented by Formula (2)-4 may be preferable.

The compound represented by Formula (1) and the phosphorus compound represented by Formula (2) may preferably be added in an amount within the range of from 0.2 to 20% by weight, and particularly preferably from 0.5 to 17% by weight, in total based on the total weight of the photosensitive layer to which the compounds are added. These may preferably be mixed in a ratio of the compounds Formula (1):Formula (2) of from 0.1:1 to 1:0.1, and particularly preferably from 0.3:1 to 1:0.3. If these are added in an amount less than 0.2% by weight in total, their addition may be less effective. If these are added in an amount more than 20% by weight, a difficulty such as a decrease in sensitivity and an increase in residual potential tends to occur.

The photosensitive layer used in the present invention may have a form of a single-layer type in which a charge-generating material and a charge-transporting material are contained in the same layer, or a laminated multi-layer type which has a charge generation layer containing a charge-generating material and a charge transport layer containing a charge-transporting material.

The charge-generating material used in the present invention may include pyrylium dyes, thiopyrylium dyes, phthalocyanine pigments, anthanthrone pigments, dibenzpyrenequinone pigments, pyranthrone pigments, azo pigments, indigo pigments, quinacridone pigments and quinocyanine pigments.

The charge-transporting material used in the present invention may include hydrazone compounds, pyrazoline compounds, styryl compounds, oxazole compounds, thiazole compounds, triarylamine compounds, triarylmethane compounds, and polyarylalkane compounds.

In the present invention, in view of the matching between the compound represented by Formula (1) and the phosphorus compound represented by Formula (2), the charge-transporting material may preferably be at least one of a styryl compound represented by the following Formula (3), a triarylamine compound represented by the following Formula (4) and a hydrazone compound represented by the following Formula (5):

(3)

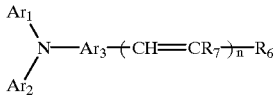

wherein $Ar_1$ and $Ar_2$ each represent an aromatic hydrocarbon ring group; $Ar_3$ represents a divalent aromatic hydrocarbon ring group or a divalent heterocyclic group; $R_6$ represents an alkyl group or an 25 aromatic hydrocarbon ring group; $R_7$ represents a hydrogen atom, an alkyl group or an aromatic hydrocarbon ring group; n is 1 or 2; and $R_6$ and $R_7$ may combine to form a ring when n is 1, (4)

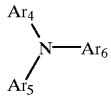

wherein $Ar_4$, $Ar_5$ and $Ar_6$ each represent an aromatic hydrocarbon ring group or a heterocyclic group, (5)

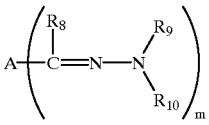

wherein $R_8$ represents a hydrogen atom or an alkyl group; $R_9$ and $R_{10}$each represent an alkyl group or an aromatic hydrocarbon ring group; m is 1 or 2; and A represents an aromatic hydrocarbon ring group, a heterocyclic group or —CH═C($R_{11}$)$R_{12}$, where $R_{11}$ and $R_{12}$ each represent a hydrogen atom, an aromatic hydrocarbon ring group or a heterocyclic group, provided that $R_{11}$ and $R_{12}$ are not hydrogen atoms at the same time.

$Ar_1$ and $Ar_2$ in Formula (3) each represent an aromatic hydrocarbon ring group such as phenyl, naphthyl or anthryl. $Ar_3$ represents an aromatic hydrocarbon ring group such as benzene, naphthalene or anthracene, or a divalent group formed by removing two hydrogen atoms from a heterocyclic ring such as thiophene or furan. $R_6$ represents an alkyl group such as methyl, ethyl, propyl or butyl, or an aromatic hydrocarbon ring group such as phenyl or naphthyl. $R_7$ represents an alkyl group such as methyl, ethyl, propyl or butyl, an aromatic hydrocarbon ring group such as phenyl or naphthyl, or a hydrogen atom. Letter symbol n represents 1 or 2.

Any of $Ar_1$, $Ar_2$, $Ar_3$, $R_6$ and $R_7$ may have a substituent, and the substituent may include alkyl groups such as methyl, ethyl, propyl and butyl, alkoxyl groups such as methoxyl, ethoxyl and propoxyl, aryloxy groups such as phenoxy and naphthoxy, halogen atoms such as a fluorine atom, a chlorine atom and a bromine atom, and di-substituted amino groups such as dimethylamino, diethylamino and diphenylamino. When n is 1, $R_6$ and $R_7$ may combine directly or through a carbon atom, a sulfur atom or an oxygen atom to form a ring.

$Ar_4$, $Ar_5$ and $Ar_6$ each represent an aromatic hydrocarbon ring group such as phenyl, naphthyl, anthryl, pyrenyl, fluorenyl, phenanthryl, 9,10-dihydrophenanthryl and fluorenyl, or a heterocyclic group such as pyridyl, quinolyl, dibenzothienyl, dibenzofuryl, N-methylcarbazole, N-ethylcarbazole and N-tolylcarbazole.

Any of $Ar_4$, $Ar_5$ and $R_6$ may have a substituent, and the substituent may include alkyl groups such as methyl, ethyl, propyl and butyl, aralkyl groups such as benzyl, phenethyl and naphthylmethyl, alkoxyl groups such as methoxyl, ethoxyl and propoxyl, aryloxy groups such as phenoxy and naphthoxy, halogen atoms such as a fluorine atom, a chlorine atom, a bromine atom and an iodine atom, aromatic hydrocarbon ring groups such as phenyl and biphenyl, and diarylamino groups such as diphenylamino and ditolylamino, dialkylamino groups such as dimethylamino and diethylamino, alkylaralkylamino groups such as benzylmethylamino and benzylethylamino, a nitro group, and a hydroxyl group.

$R_8$ represents an alkyl group such as methyl, ethyl and propyl, or a hydrogen atom. $R_9$ and $R_{10}$ each represent an alkyl group such as methyl, ethyl and propyl, an aralkyl group such as benzyl or phenethyl, or an aromatic hydrocarbon ring group such as phenyl, naphthyl or anthryl. $R_9$ and $R_{10}$ may combine to form a ring. Letter symbol m represents 1 or 2. Any of $R_8$, $R_9$ and $R_{10}$ may also have a substituent, and the substituent may include alkyl groups such as methyl and ethyl, alkoxyl groups such as methoxyl and ethoxyl, and halogen atoms such as a fluorine atom, a chlorine atom and a bromine atom.

A represents an aromatic hydrocarbon ring group such as phenyl, naphthyl, anthryl and pyrenyl, a heterocyclic group such as thienyl, furyl, N-methylcarbazole or N-ethylcarbazole, or —CH═C($R_{11}$)$R_{12}$, where $R_{11}$ and $R_{12}$ each represent a hydrogen atom, an aromatic hydrocarbon ring group such as those described above or a heterocyclic group such as those described above, provided that $R_{11}$ and $R_{12}$ are not hydrogen atoms at the same time. These aromatic hydrocarbon ring group and heterocyclic group may also each have a substituent, and the substituent may include alkyl groups such as methyl and ethyl, alkoxyl groups such as methoxyl and ethoxyl, halogen atoms such as a fluorine atom, a chlorine atom and a bromine atom, dialkylamino groups such as dimethylamino and diethylamino, diaralkylamino groups such as dibenzylamino and diphenethylamino, and diarylamino groups such as diphenylamino and di-p-tolylamino.

Preferred examples of the styryl compound represented by Formula (3), the triarylamine compound represented by Formula (4) and the hydrazone compound represented by Formula (5) are given below.

Exemplary Compound (3)-1

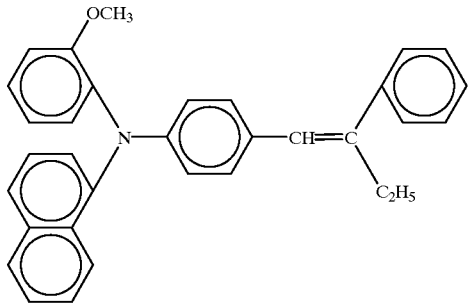

Exemplary Compound (3)-2

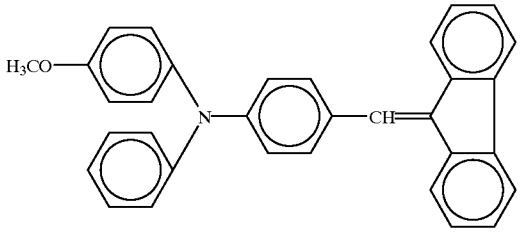

Exemplary Compound (3)-3

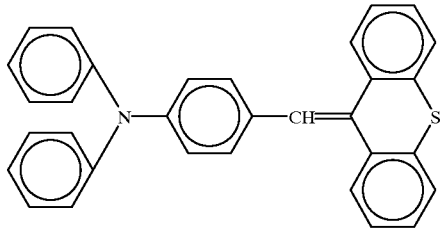

Exemplary Compound (3)-4

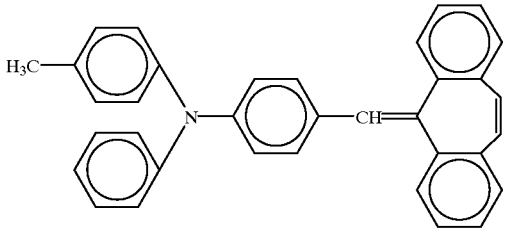

Exemplary Compound (3)-5

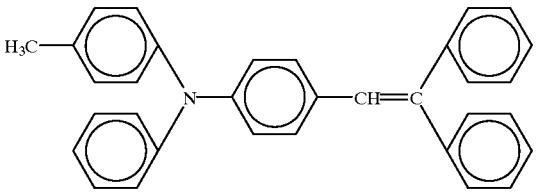

Exemplary Compound (3)-6

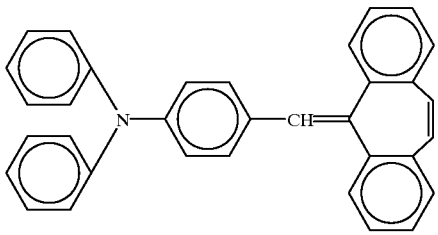

-continued
Exemplary Compound (3)-7
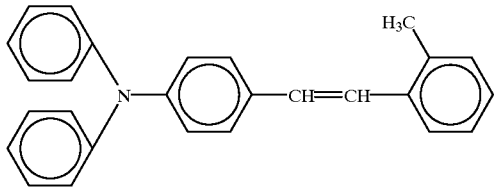
Exemplary Compound (3)-8
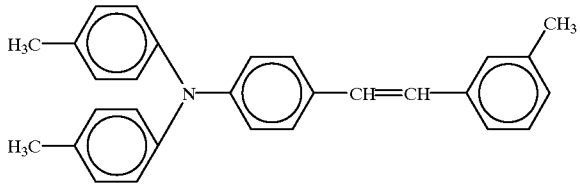
Exemplary Compound (3)-9
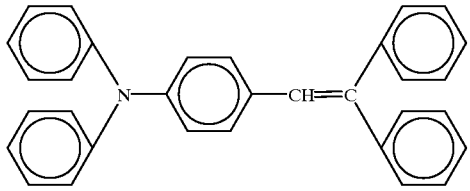
Exemplary Compound (3)-10
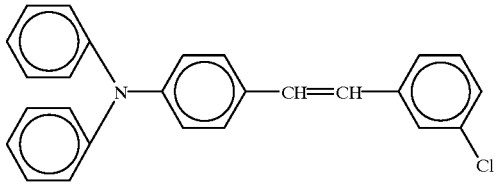
Exemplary Compound (3)-11
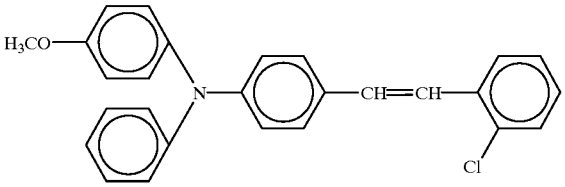
Exemplary Compound (3)-12
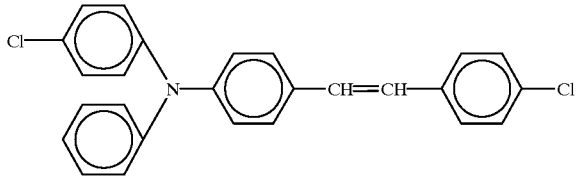
Exemplary Compound (3)-13
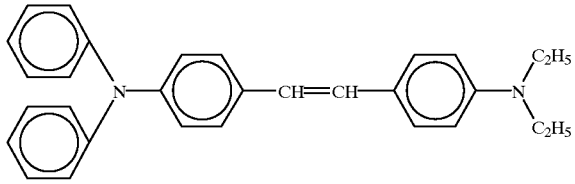
Exemplary Compound (3)-14
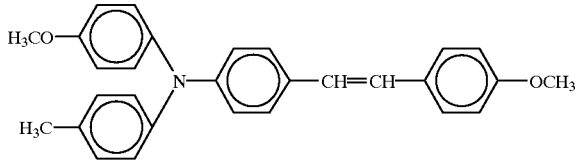
Exemplary Compound (3)-15
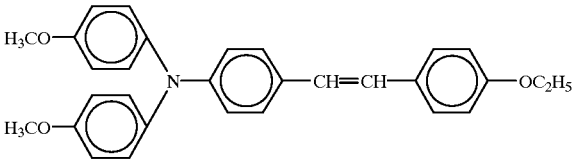
Exemplary Compound (3)-16
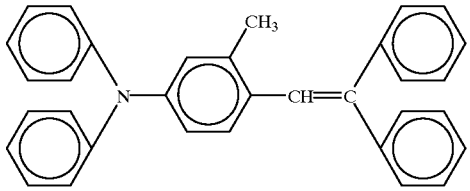
Exemplary Compound (3)-17
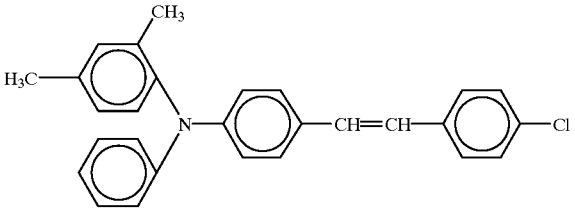
Exemplary Compound (3)-18
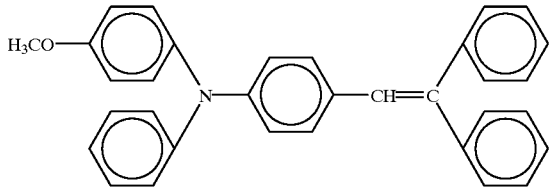

-continued
Exemplary Compound (3)-19
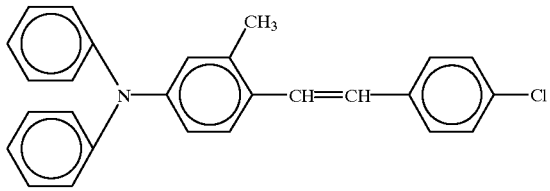
Exemplary Compound (3)-20
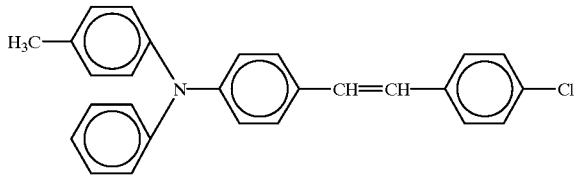
Exemplary Compound (3)-21
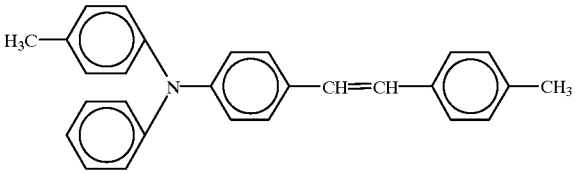
Exemplary Compound (3)-22
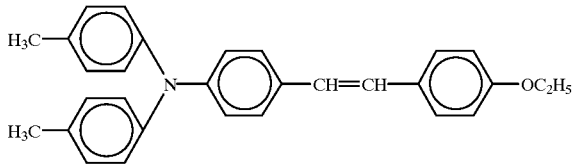
Exemplary Compound (3)-23
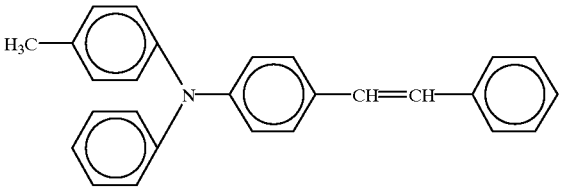
Exemplary Compound (3)-24
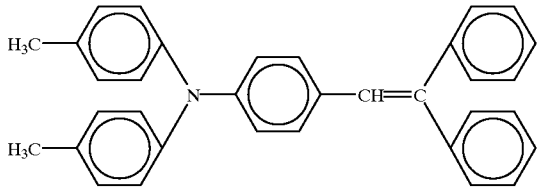
Exemplary Compound (3)-25
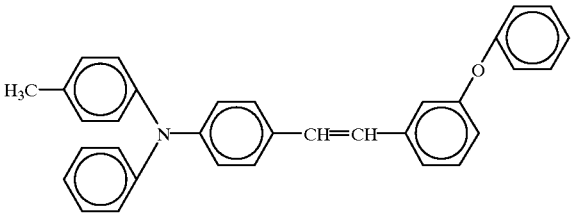
Exemplary Compound (3)-26
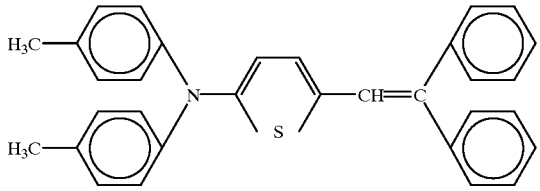
Exemplary Compound (3)-27
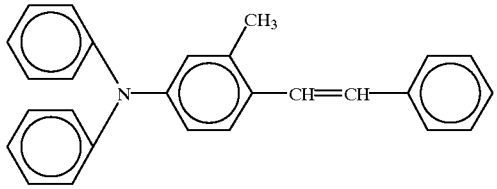
Exemplary Compound (3)-28
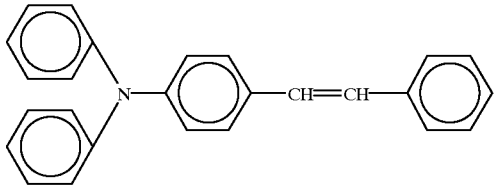

-continued
Exemplary Compound (3)-29
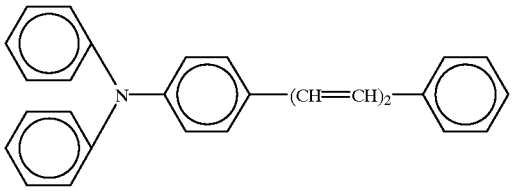
Exemplary Compound (3)-30
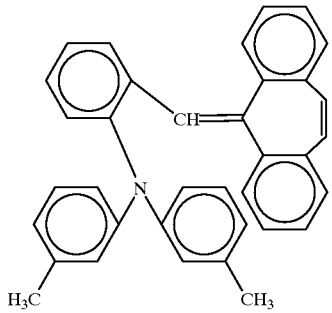
Exemplary Compound (3)-31
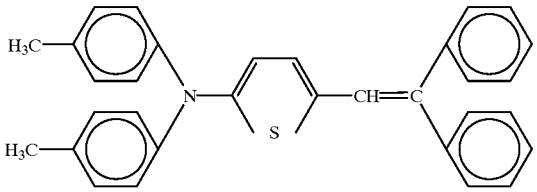
Exemplary Compound (3)-32
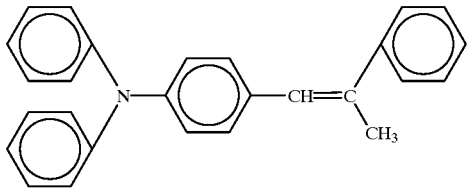
Exemplary Compound (3)-33
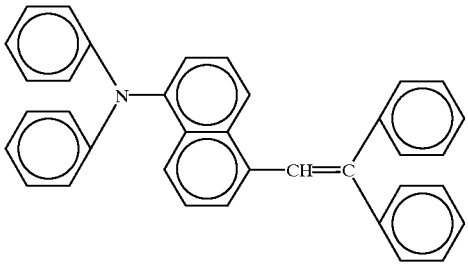
Exemplary Compound (3)-34
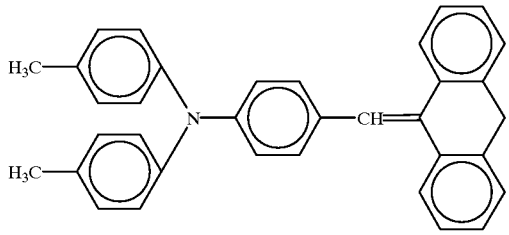
Exemplary Compound (3)-35
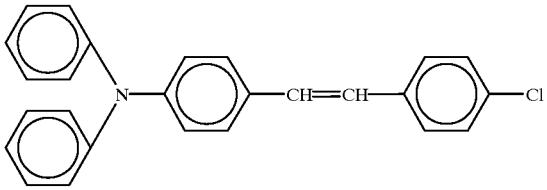
Exemplary Compound (3)-36
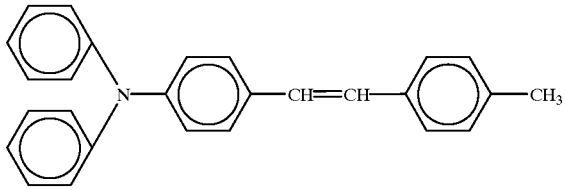
Exemplary Compound (3)-37
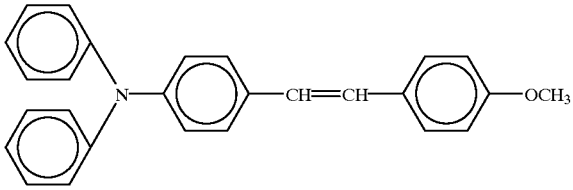
Exemplary Compound (3)-38
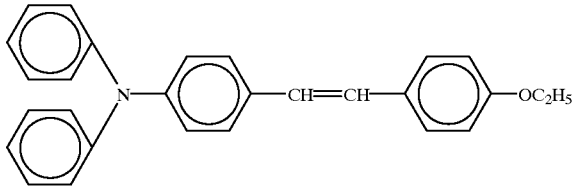
Exemplary Compound (3)-39
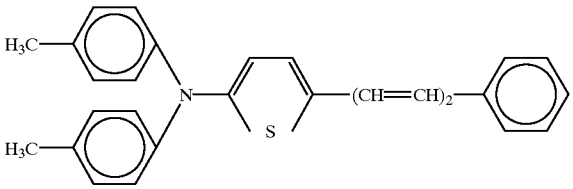
Exemplary Compound (3)-40
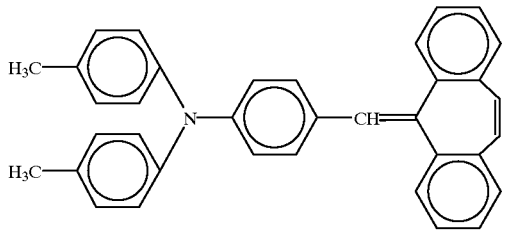

-continued
Exemplary Compound (4)-1
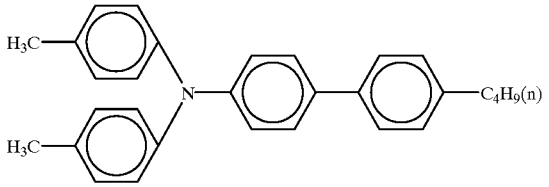
Exemplary Compound (4)-2
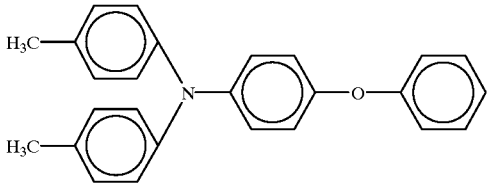
Exemplary Compound (4)-3
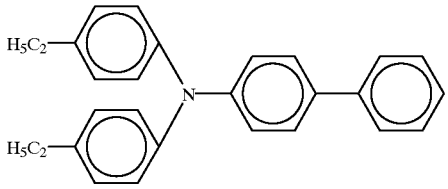
Exemplary Compound (4)-4
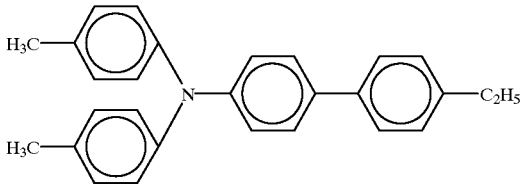
Exemplary Compound (4)-5
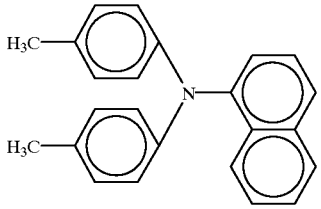
Exemplary Compound (4)-6
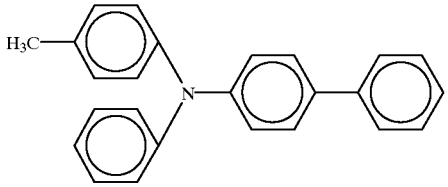
Exemplary Compound (4)-7
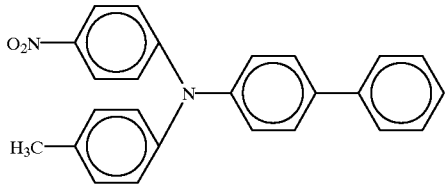
Exemplary Compound (4)-8
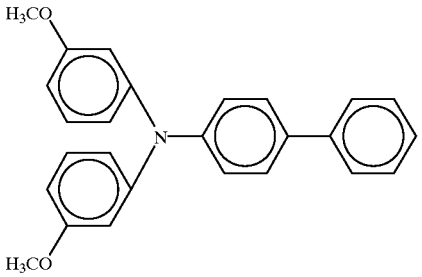
Exemplary Compound (4)-9
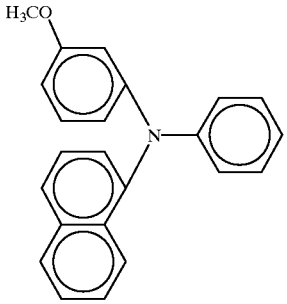
Exemplary Compound (4)-10
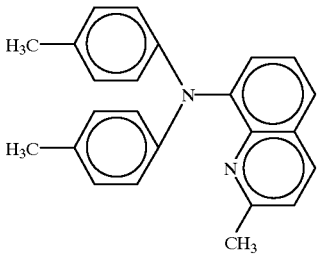
Exemplary Compound (4)-11
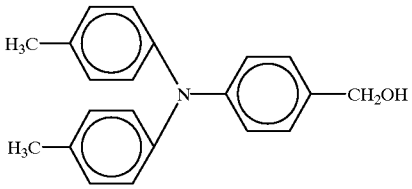
Exemplary Compound (4)-12
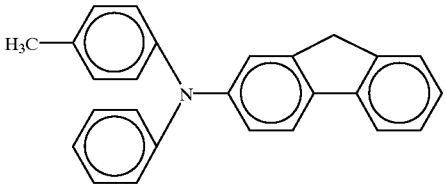

-continued
Exemplary Compound (4)-13
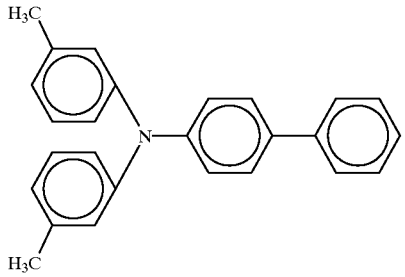
Exemplary Compound (4)-14
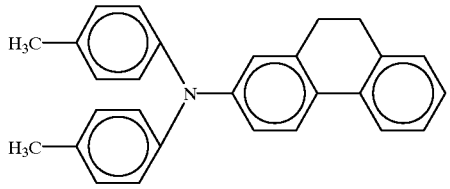
Exemplary Compound (4)-15
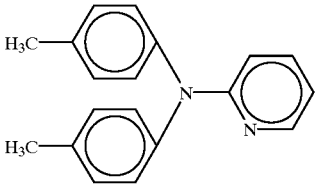
Exemplary Compound (4)-16
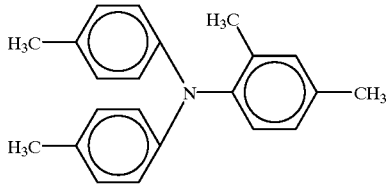
Exemplary Compound (4)-17
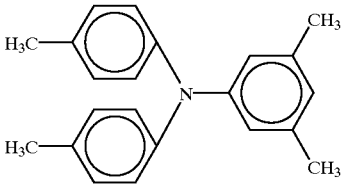
Exemplary Compound (4)-18
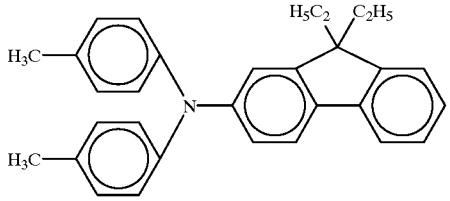
Exemplary Compound (4)-19
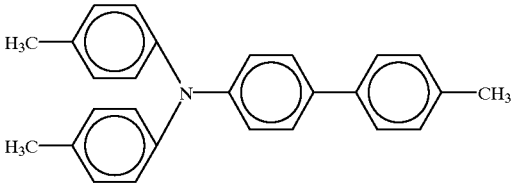
Exemplary Compound (4)-20
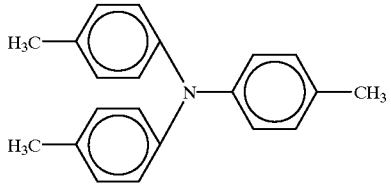
Exemplary Compound (4)-21
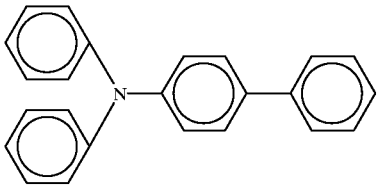
Exemplary Compound (4)-22
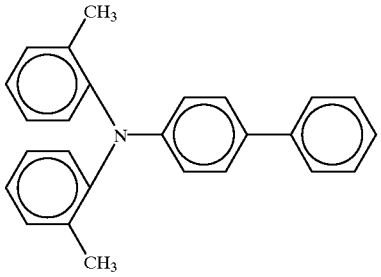
Exemplary Compound (4)-23
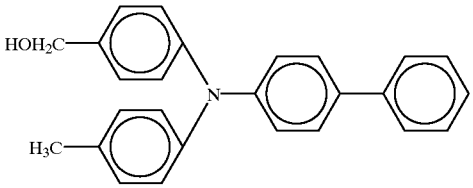
Exemplary Compound (4)-24
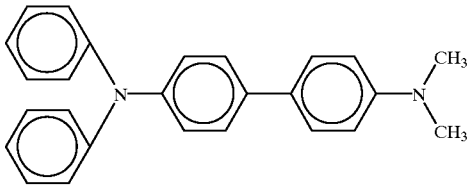

-continued
Exemplary Compound (4)-25
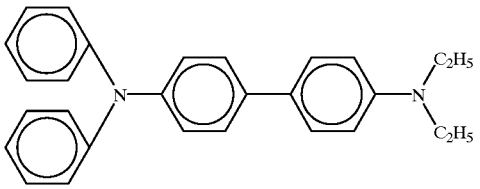
Exemplary Compound (4)-26
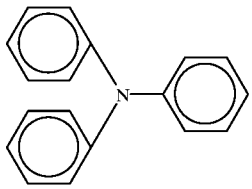
Exemplary Compound (4)-27
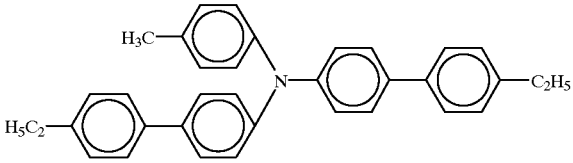
Exemplary Compound (4)-28
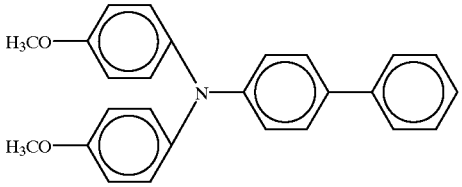
Exemplary Compound (4)-29
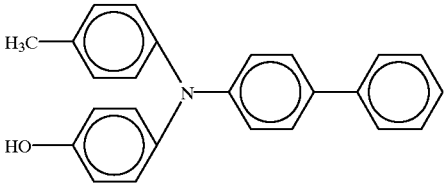
Exemplary Compound (4)-30
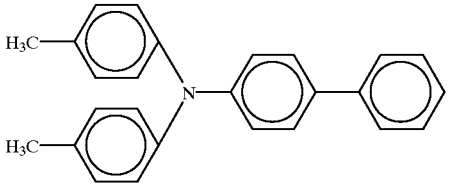
Exemplary Compound (4)-31
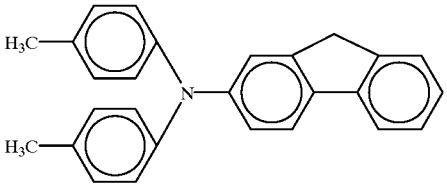
Exemplary Compound (4)-32
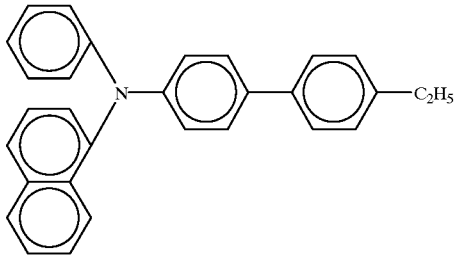
Exemplary Compound (4)-33
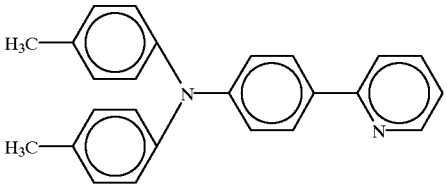
Exemplary Compound (4)-34
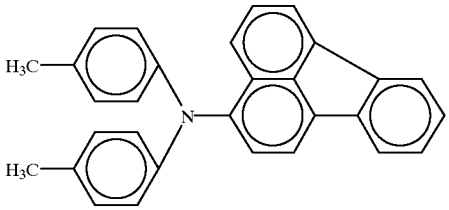
Exemplary Compound (4)-35
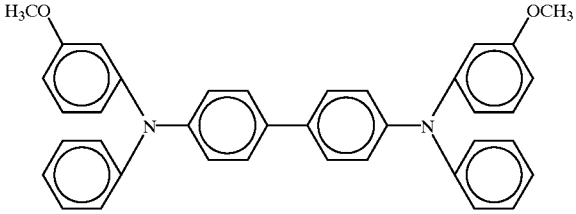
Exemplary Compound (4)-36
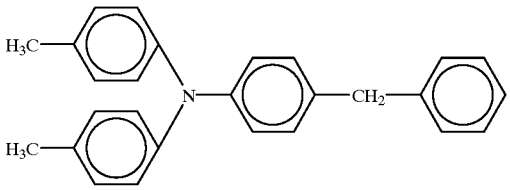

-continued
Exemplary Compound (4)-37
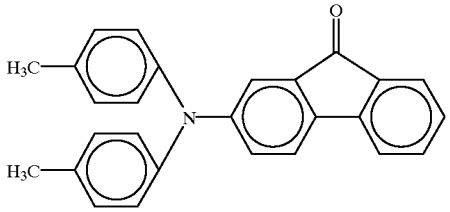
Exemplary Compound (4)-38
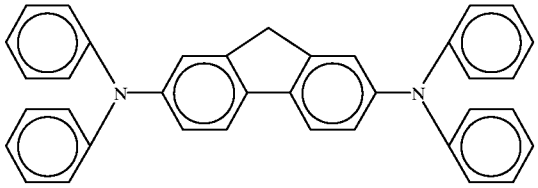
Exemplary Compound (4)- 39
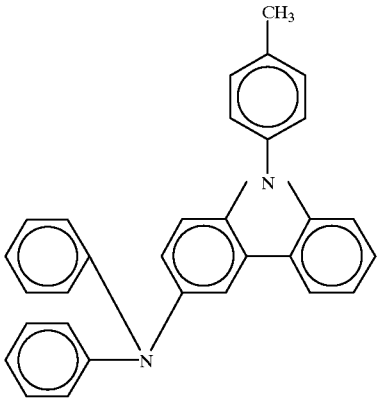
Exemplary Compound (4)-40
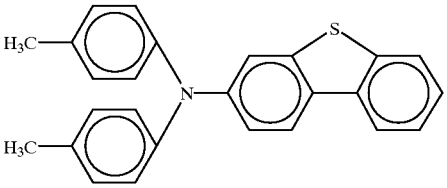
Exemplary Compound (4)-41
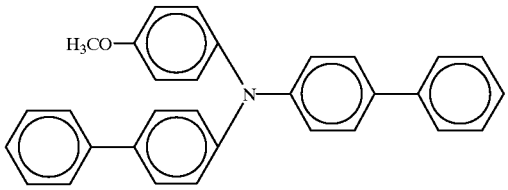
Exemplary Compound (4)-42
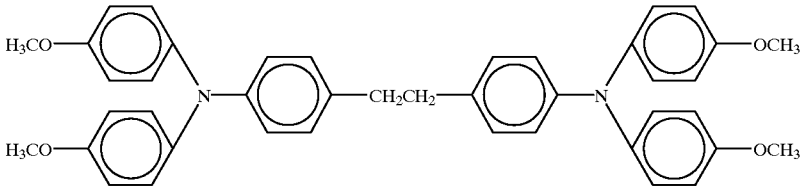
Exemplary Compound (4)-43
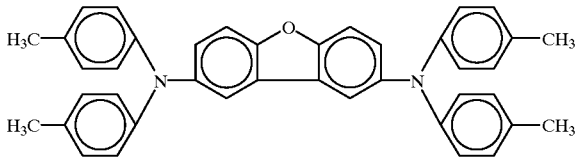
Exemplary Compound (4)-44
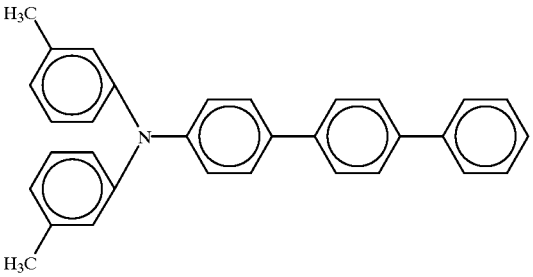

-continued
Exemplary Compound (4)-45
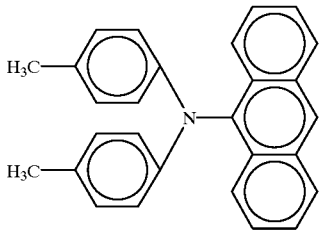
Exemplary Compound (4)-46
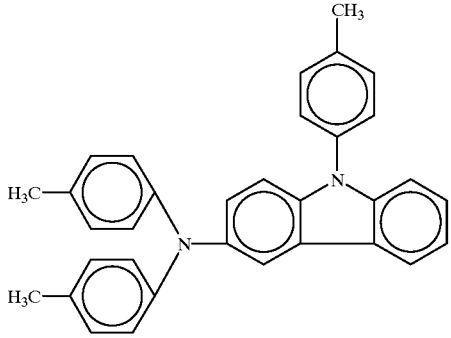
Exemplary Compound (4)-47
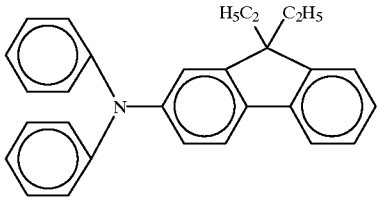
Exemplary Compound (4)-48
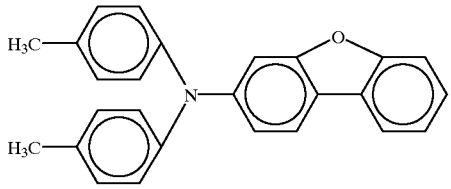
Exemplary Compound (4)-49
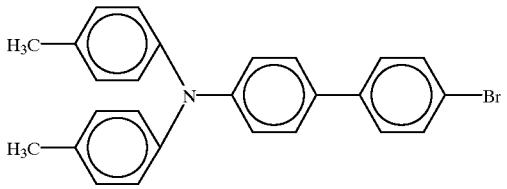
Exemplary Compound (4)-50
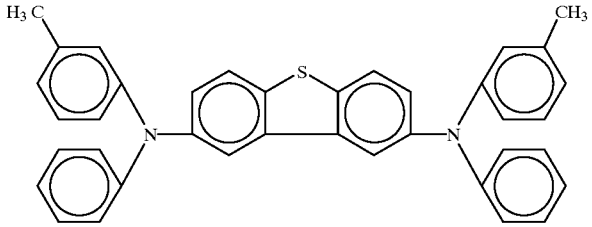
Exemplary Compound (4)-51
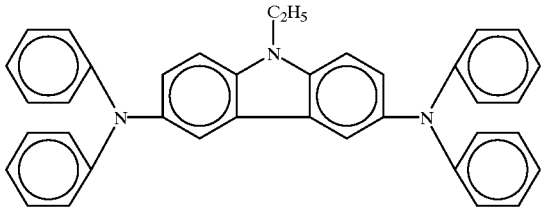
Exemplary Compound (4)-52
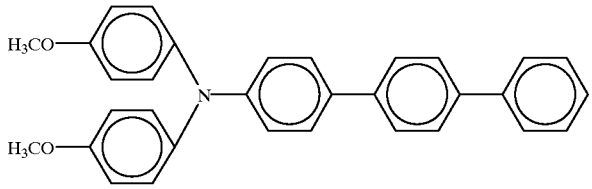
Exemplary Compound (4)-53
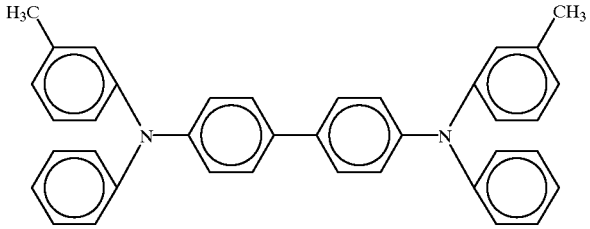
Exemplary Compound (4)-54
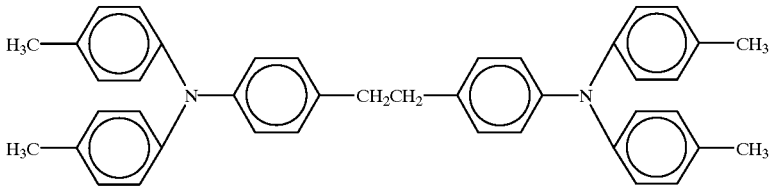

-continued
Exemplary Compound (4)-55
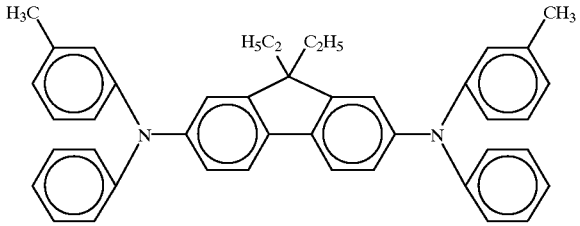
Exemplary Compound (4)-56
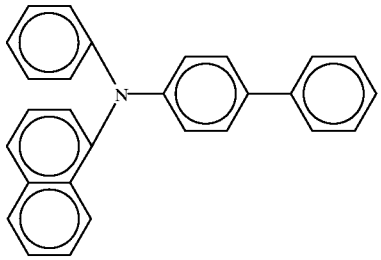
Exemplary Compound (4)-57
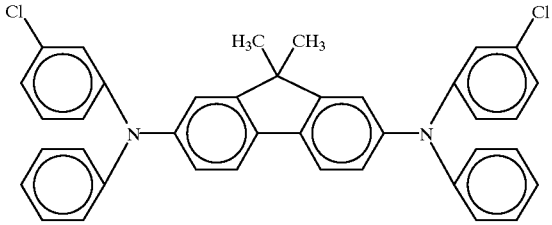
Exemplary Compound (4)-58
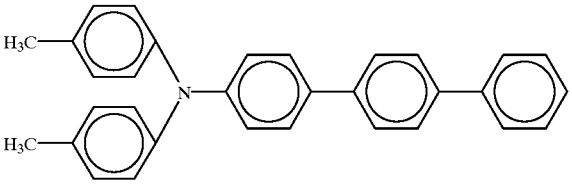
Exemplary Compound (4)-59
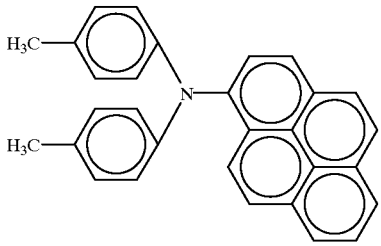
Exemplary Compound (4)-60
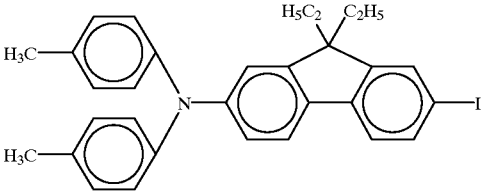
Exemplary Compound (4)-61
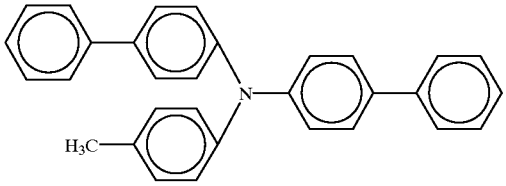
Exemplary Compound (4)-62
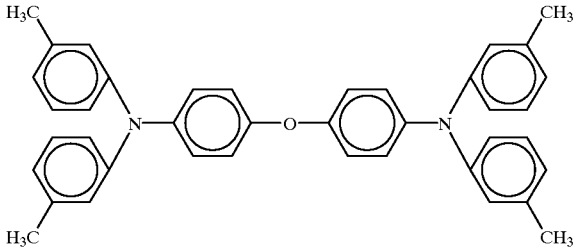
Exemplary Compound (4)-63
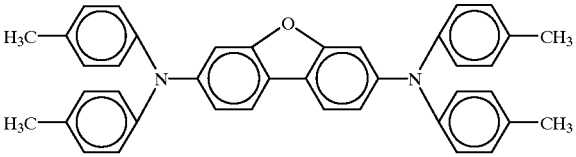
Exemplary Compound (4)-64
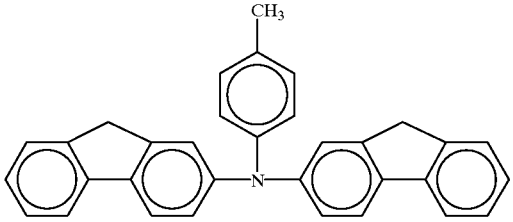
Exemplary Compound (4)-65
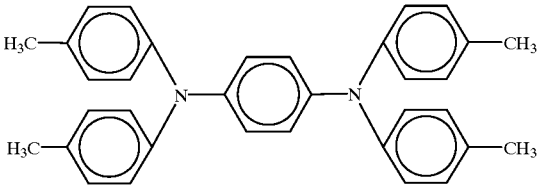

-continued
Exemplary Compound (4)-66
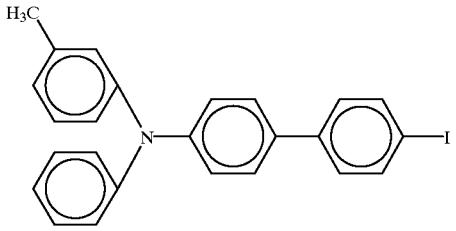
Exemplary Compound (4)-67
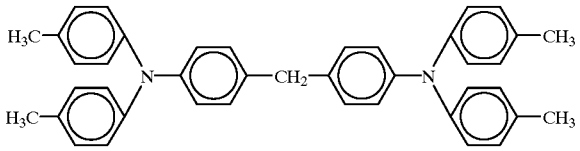
Exemplary Compound (4)-68
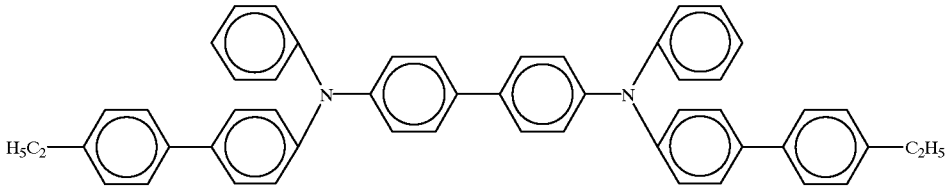
Exemplary Compound (4)-69
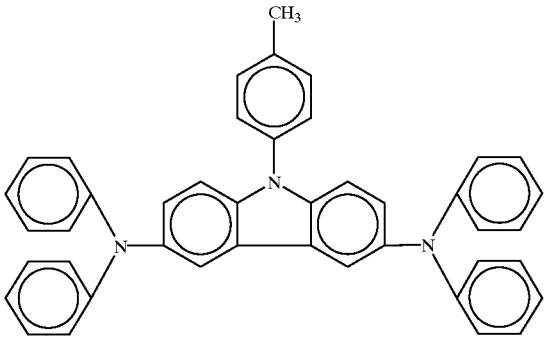
Exemplary Compound (4)-70
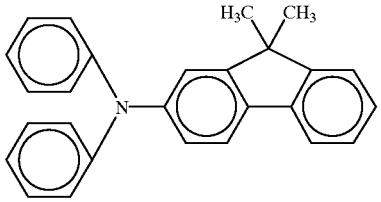
Exemplary Compound (4)-71
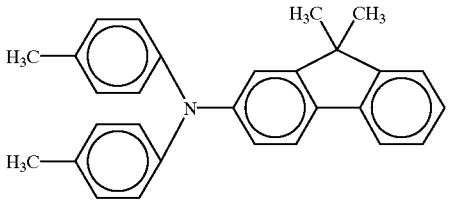
Exemplary Compound (5)-1
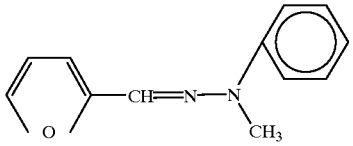
Exemplary Compound (5)-2
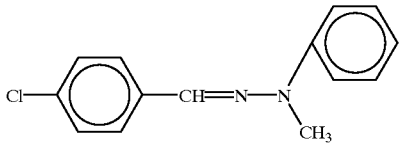
Exemplary Compound (5)-3
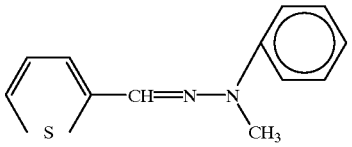
Exemplary Compound (5)-4
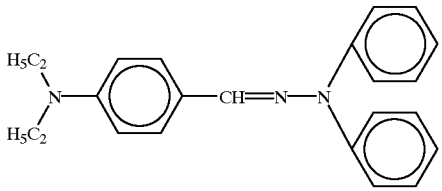
Exemplary Compound (5)-5
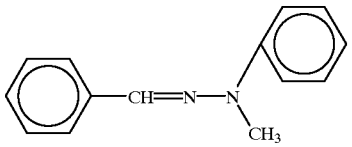

-continued
Exemplary Compound (5)-6
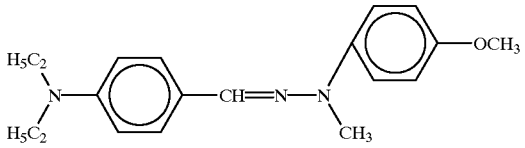
Exemplary Compound (5)-7
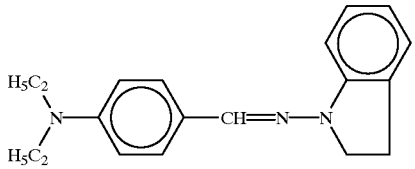
Exemplary Compound (5)-8
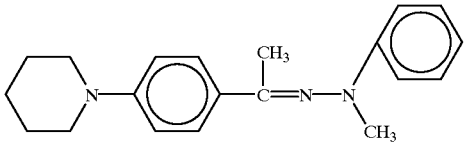
Exemplary Compound (5)-9
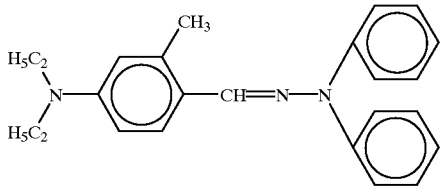
Exemplary Compound (5)-10
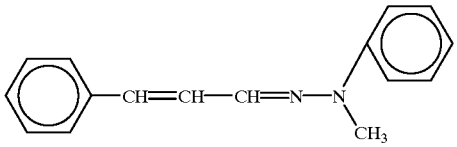
Exemplary Compound (5)-11
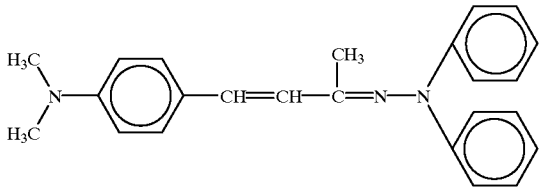
Exemplary Compound (5)-12
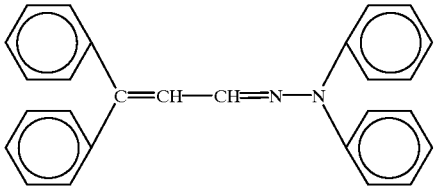
Exemplary Compound (5)-13
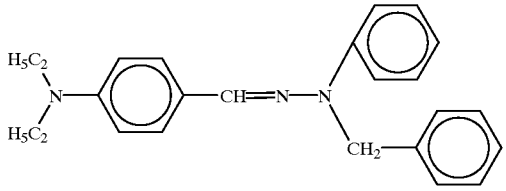
Exemplary Compound (5)-14
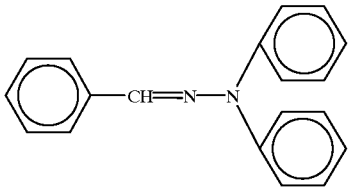
Exemplary Compound (5)-15
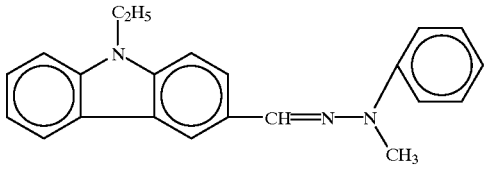
Exemplary Compound (5)-16
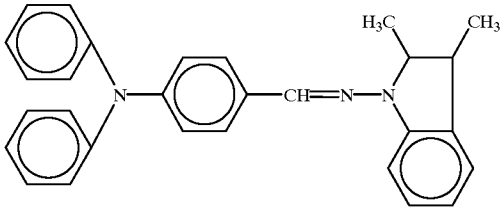

-continued
Exemplary Compound (5)-17
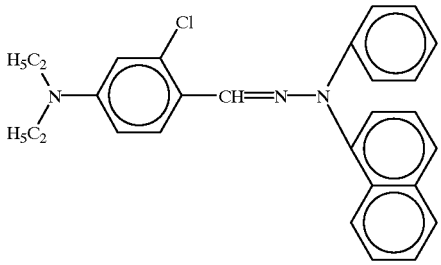
Exemplary Compound (5)-18
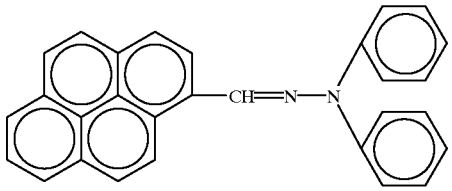
Exemplary Compound (5)-19
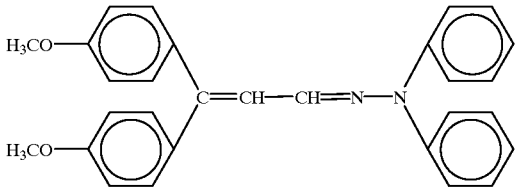
Exemplary Compound (5)-20
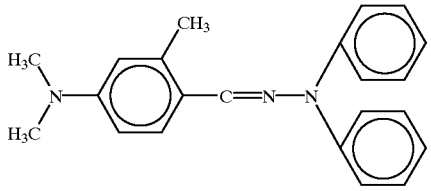
Exemplary Compound (5)-21
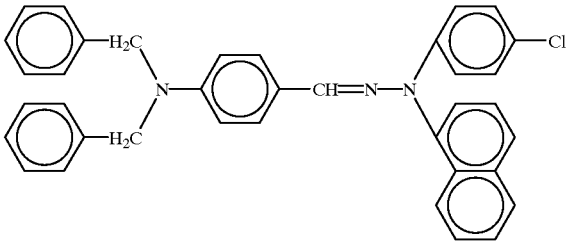
Exemplary Compound (5)-22
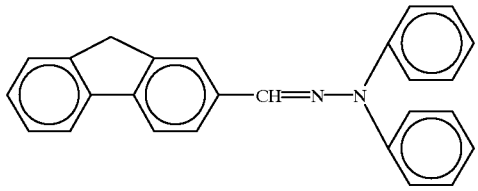
Exemplary Compound (5)-23
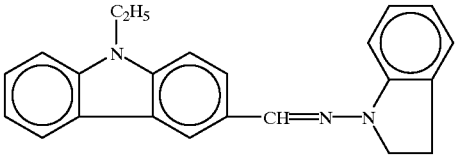
Exemplary Compound (5)-24
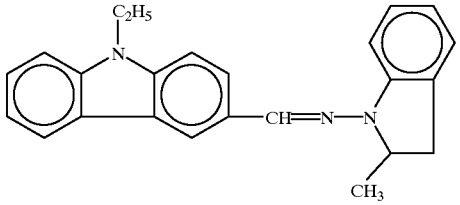
Exemplary Compound (5)-25
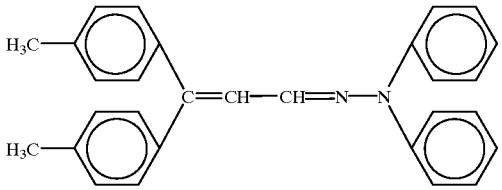
Exemplary Compound (5)-26
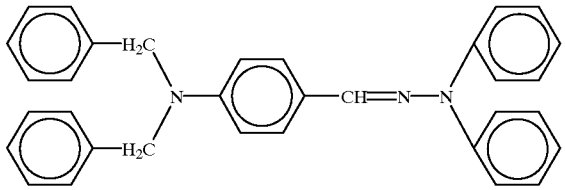
Exemplary Compound (5)-27
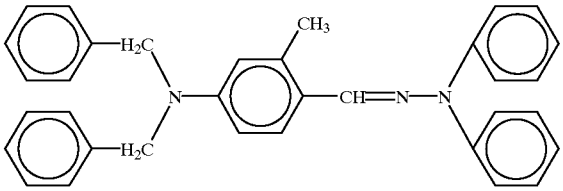
Exemplary Compound (5)-28
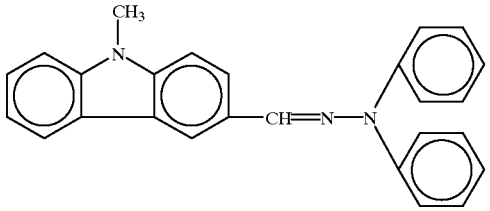

-continued
Exemplary Compound (5)-29
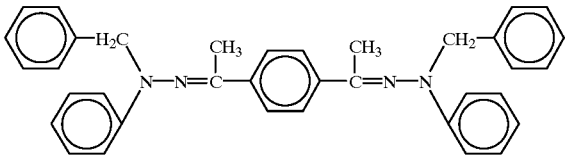
Exemplary Compound (5)-30
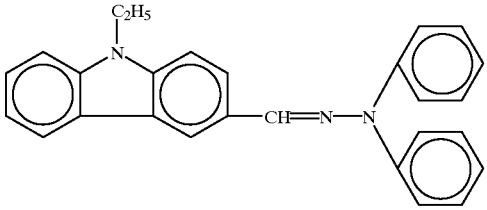
Exemplary Compound (5)-31
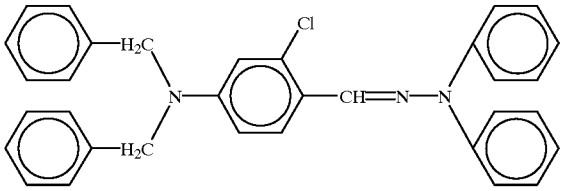
Exemplary Compound (5)-32
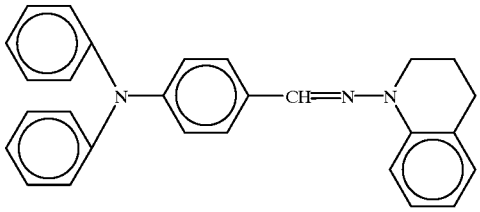
Exemplary Compound (5)-33
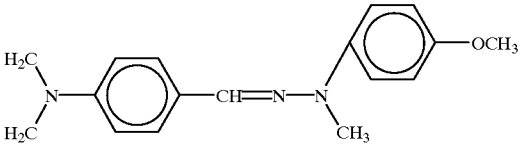
Exemplary Compound (5)-34
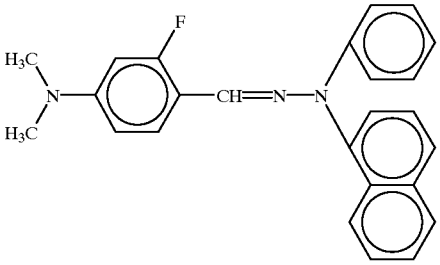
Exemplary Compound (5)-35
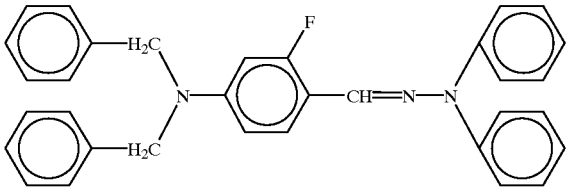
Exemplary Compound (5)-36
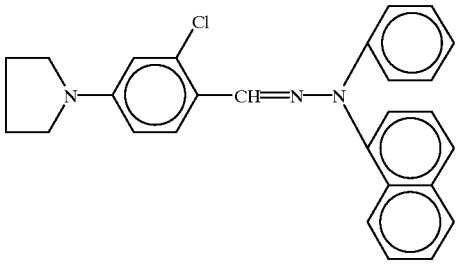
Exemplary Compound (5)-37
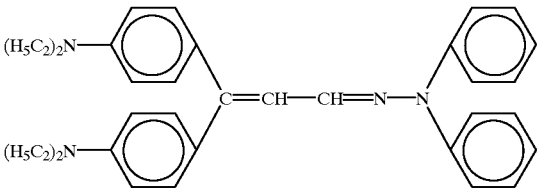
Exemplary Compound (5)-38
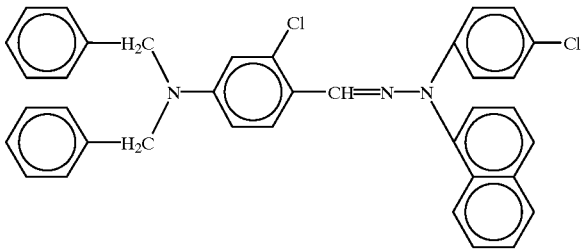

-continued

Exemplary Compound (5)-39

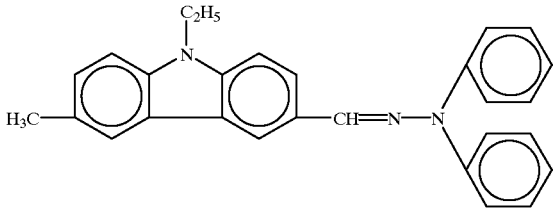

Exemplary Compound (5)-40

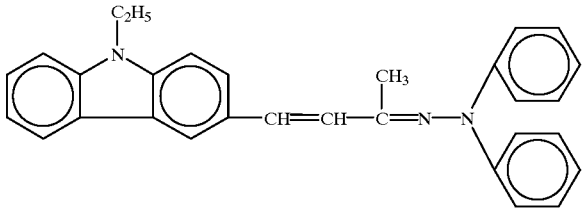

Exemplary Compound (5)-41

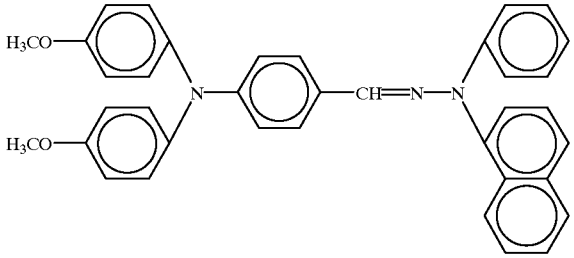

Exemplary Compound (5)-42

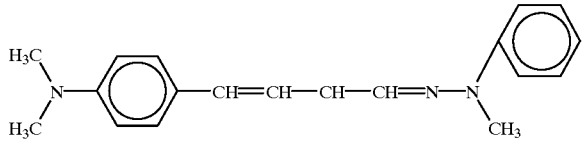

Exemplary Compound (5)-43

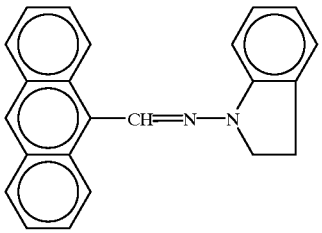

Exemplary Compound (5)-44

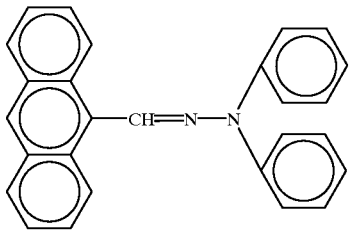

Exemplary Compound (5)-45

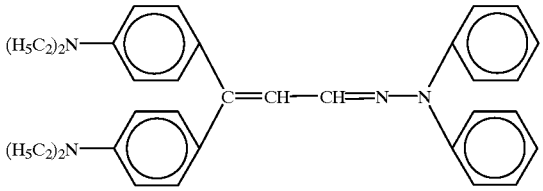

In the case of the single-layer type, the photosensitive layer can be formed by coating a fluid prepared by dispersing and dissolving the above charge-generating material and charge-transporting material in a suitable binder, followed by drying.

The laminated multi-layer type is grouped into one in which the charge generation layer and the charge transport layer are formed in this order and one in which the charge transport layer and the charge generation layer are formed in this order.

In the former, the charge generation layer can be formed by coating a fluid prepared by dissolving the charge-generating material in a binder resin and a solvent or dispersing them by means of a homogenizer, an ultrasonic dispersion machine, a ball mill, a vibration ball mill, a sand mill, an attritor or a roll mill, followed by drying. Alternatively, it may be formed by vacuum deposition or sputtering. It may preferably have a layer thickness of 5 $\mu$m or smaller, and particularly preferably within the range of from 0.01 to 2 $\mu$m. In this instance, an inorganic photoconductive material such as selenium or amorphous silicon may also be used.

The charge transport layer is formed on the charge generation layer by coating a solution prepared by dissolving the charge-transporting material in a suitable binder resin, followed by drying. It may preferably have a layer thickness within the range of from 5 to 40 $\mu$m, and particularly preferably within the range of from 8 to 30 $\mu$m.

In this instance, the compound represented by Formula (1) and phosphorus compound represented by Formula (2) in the present invention may preferably be incorporated in the charge transport layer.

As for the type where the charge generation layer is superposed on the charge transport layer, both the layers can be formed by coating the above organic photoconductive materials together with binder resins. Here, the charge-transporting material may preferably be incorporated also in the charge generation layer.

The compound represented by Formula (1) and phosphorus compound represented by Formula (2) in the present invention may preferably be incorporated in the charge generation layer or in both the charge generation layer and the charge transport layer.

In the present invention, fluorine-atom-containing resin particles may also be incorporated in the photosensitive layer. Usable fluorine-atom-containing resin particles may preferably be particles of at least one appropriately selected from tetrafluoroethylene resin, trifluorochloroethylene resin, hexafluoroethylene propylene resin, vinyl fluoride resin, vinylidene fluoride resin, difluorodichloroethylene resin, and copolymers of any of these. In particular, particles of tetrafluoroethylene resin or vinylidene fluoride resin are preferred. The resin particles may have molecular weight and particle diameter which may be appropriately selected without any particular limitations.

In the present invention, as a protective layer, a resin layer or a resin layer containing conductive particles or charge-transporting material may be provided on the photosensitive layer. In this instance, the compound represented by Formula (1) and phosphorus compound represented by Formula (2) in the present invention may preferably be incorporated in the protective layer or in both the protective layer and the photosensitive layer. In the present invention, the protective layer is defined to be also a kind of the photosensitive layer.

The support used in the present invention may be any of those having a conductivity. It may include (1) those made of a metal or alloy such as aluminum, an aluminum alloy, stainless steel and copper, (2) non-conductive supports such as glass, resin and paper or the above (1) conductive supports on which a metal or alloy such as aluminum, an aluminum alloy, palladium, rhodium, gold or platinum has been vacuum-deposited or laminated to form a thin film, and (3) non-conductive supports such as glass, resin and paper or the above (1) or (2) conductive supports on which a conductive material such as a conductive polymer, tin oxide or indium oxide has been vacuum-deposited or a fluid prepared by dispersing such a conductive material in a suitable binder resin has been coated, followed by drying, to form a thin film.

The support may have a form including the form of a drum, the form of a sheet and the form of a belt, and may preferably be made to have a form suited to electrophotographic apparatus to be used.

In the present invention, a subbing layer having the function of adhesion and the function as a barrier may be provided between the support and the photosensitive layer. The subbing layer can be formed using casein, polyvinyl alcohol, nitrocellulose, polyamides (such as nylon 6, nylon 66, nylon 610, copolymer nylon and alkoxymethylated nylon), polyurethane or aluminum oxide. The subbing layer may preferably have a layer thickness of 5 $\mu$m or less, and particularly preferably from 0.1 to 3 $\mu$m.

When the various layers described above are formed by coating, the coating process may include dip coating, spray coating, spin coating, roller coating, Mayer bar coating and blade coating.

The electrophotographic photosensitive member of the present invention may be not only applied in electrophotographic copying machines, but also widely applied in the fields where electrophotography is applied, e.g., laser beam printers, CRT printers, LED printers, facsimile systems and electrophotographic engraving systems.

The process cartridge and electrophotographic apparatus of the present invention will be described below. FIGURE schematically illustrates the construction of an electrophotographic apparatus having a process cartridge having the electrophotographic photosensitive member of the present invention.

In the FIGURE, reference numeral 1 denotes a drum type electrophotographic photosensitive member of the present invention, which is rotatingly driven around an axis 2 in the direction of an arrow at a given peripheral speed. The photosensitive member 1 is, in the course of its rotation, uniformly electrostatically charged on its periphery to a positive or negative, given potential through a primary charging means 3. The photosensitive member thus charged is then imagewise exposed to light 4 emitted from an exposure means (not shown) for slit exposure or laser beam scanning exposure. Thus, an electrostatic latent image is formed.

The electrostatic latent image thus formed is subsequently developed by toner (made into a visible image) by the operation of a developing means 5. The toner image thus formed on the photosensitive member 1 is further transferred by the operation of a transfer means 6, to the surface of a transfer medium 7 fed from a paper feed section (not shown) to the part between the photosensitive member 1 and the transfer means 6. The transfer medium on which the toner image has been formed is sent through a transport section (not shown) to an image fixing means 8, where the toner image is fixed.

Meanwhile, the residual toner, not transferred to the transfer medium and having remained on the photosensitive member 1, is collected by a cleaning means 9. When any residual charges are left in the photosensitive member, it is better to apply pre-exposure light 10 to the photosensitive member 1 by a pre-exposure means (not shown) to effect charge elimination. Meanwhile, in this electrophotographic apparatus, as a light source of the imagewise exposure light 4, a halogen lamp, a fluorescent lighting, a laser or an LED may be used. Any other auxiliary process may optionally be added.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachable from the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachable from the body of the apparatus through a guide means such as a rail 12 provided in the body of the apparatus.

The present invention will be described below in greater detail by giving Examples.

EXAMPLE 1

On an aluminum cylinder of 24 mm diameter and 257 mm long used as a support, a coating fluid prepared using 10 parts (parts by weight; the same applies hereinafter) of tin-oxide-coated titanium oxide as a conductive pigment, 10 parts of titanium oxide as a resistance modifying pigment, 10 parts of phenol resin as a binder resin, 0.001 part of silicone oil as a leveling agent and 20 parts of 1/1 methanol/methyl cellosolve as a mixed solvent was coated by dip coating, followed by heat-curing at 140° C. for 30 minutes to form a conductive layer with a layer thickness of 15 $\mu$m.

Next, on this conductive layer, a solution prepared by dissolving 3 parts of N-methoxymethylated nylon and 3 parts of copolymer nylon in a mixed solvent of 65 parts of methanol and 30 parts of n-butanol was coated, followed by drying to form an intermediate layer with a layer thickness of 0.5 $\mu$m.

Next, as charge-generating materials 4 parts of a oxytitanium phthalocyanine having strong peaks at 9.0°, 14.2°, 23.9° and 27.1° of diffraction angles 2θ plus-minus 0.2° as measured by CuKα characteristic X-ray diffraction and 1 part of an azo pigment represented by the formula:

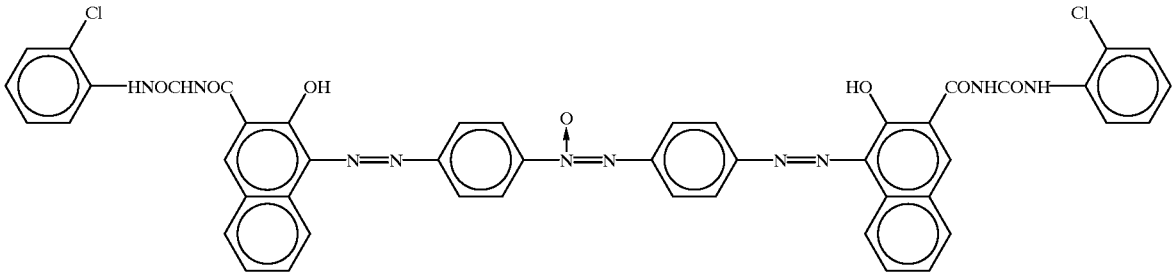

and also 3 parts of polyvinyl butyral (trade name: S-LEC BM-2; available from Sekisui Chemical Co., Ltd.) and 80 parts of cyclohexanone were dispersed for 4 hours by means of a sand grinder making use of glass beads of 1 mm diameter, followed by addition of 115 parts of methyl ethyl ketone to obtain a charge generation layer coating fluid. This coating fluid was coated on the intermediate layer by dip coating, followed by drying to form a charge generation layer with a layer thickness of 0.3 $\mu$m.

Next, 7 parts of an amine compound represented by the formula:

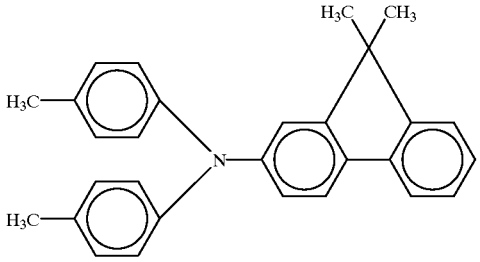

3 parts of an amine compound represented by the formula:

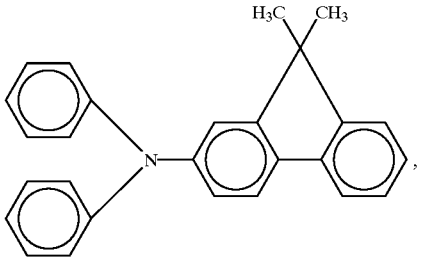

0.5 part of a compound (trade name: SUMILIZER GS; available from Sumitomo Chemical Co., Ltd.) as the compound of Formula (1), represented by the formula:

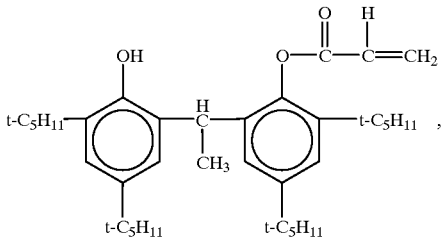

0.5 part of a phosphorus compound (trade name: IRGAFOS-168, available from Ciba-Geigy (Japan) Limited), represented by the formula:

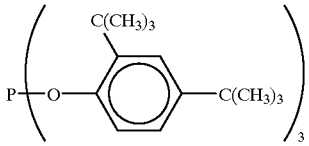

and 10 parts of a polycarbonate resin (trade name: PANLITE L-1250; available from Teijin Limited) were dissolved in a mixed solvent of 50 parts of monochlorobenzene and 10 parts of dichloromethane, The resultant coating solution was coated on the charge generation layer by dip coating, followed by drying at 110° C. for 1 hour to form a charge transport layer with a layer thickness of 20 $\mu$m. Thus, an electrophotographic photosensitive member was produced.

Using the electrophotographic photosensitive member thus produced, a running test was made. As an apparatus used in the test, a laser beam printer LASER JET 5P, manufactured by Hewlett Packard Co., was remodeled and used, which was so remodeled that its exhaust fan was removed and its main air duct was stopped up. A running test to reproduce images continuously on 5,000 sheets was made in an environment of 32.5° C. and 85% RH to evaluate image quality visually, immediately after the test was completed, and to examine variations in light-area potential between the one at the initial stage and the one after running. When the value of variation is positive, it means that the absolute value of light-area potential has increased, and, when negative, it has decreased.

The image quality was evaluated by examining whether or not smeared images occurred and, when occurred, their extent was rated in three ranks.

The results are shown in Table 1.

EXAMPLE 2

An electrophotographic photosensitive member was produced in the same manner as in Example 1 except that the charge-transporting material was replaced with a styryl compound represented by the formula:

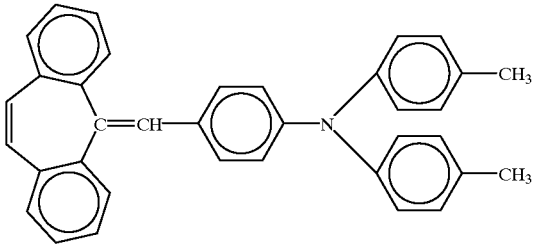

Evaluation was made similarly. The results are shown in Table 1.

EXAMPLE 3

An electrophotographic photosensitive member was produced in the same manner as in Example 1 except that the charge-generating material was replaced with an azo pigment represented by the formula:

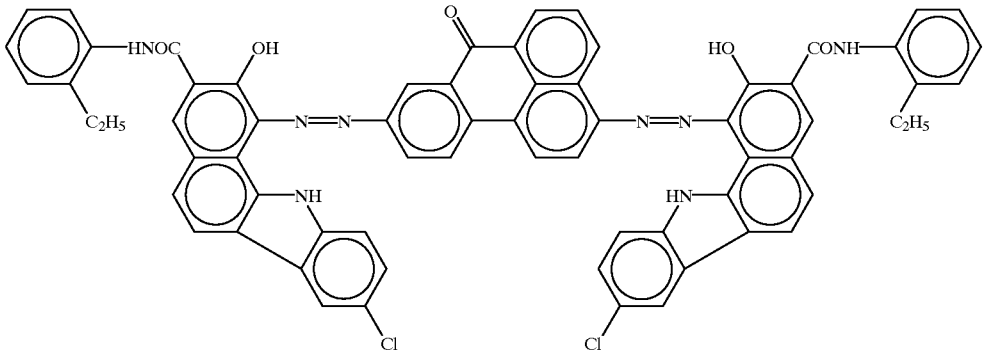

and also the resin was replaced with polyvinyl butyral (trade name: S-LEC BL-S; available from Sekisui Chemical Co., Ltd.). Evaluation was made similarly. The results are shown in Table 1.

EXAMPLE 4

An electrophotographic photosensitive member was produced in the same manner as in Example 1 except that the charge-generating material was replaced with an azo pigment represented by the formula:

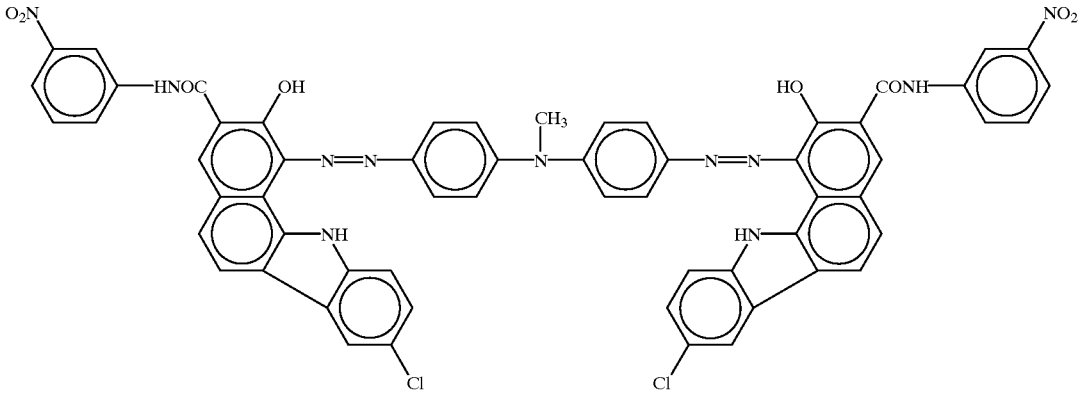

and the charge-transporting material was replaced with a hydrazone compound represented by the formula:

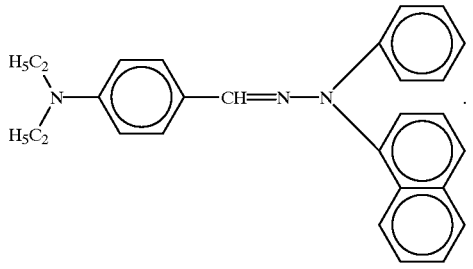

Evaluation was made similarly. The results are shown in Table 1.

EXAMPLE 5

An electrophotographic photosensitive member was produced in the same manner as in Example 1 except that the charge-generating material was replaced with an e-type copper phthalocyanine. Evaluation was made similarly. The results are shown in Table 1.

EXAMPLE 6

An electrophotographic photosensitive member was produced in the same manner as in Example 1 except that the compound represented by Formula (1) and the phosphorus compound were used in an amount of 0.3 part and 0.7 part, respectively. Evaluation was made similarly. The results are shown in Table 1.

EXAMPLE 7

An electrophotographic photosensitive member was produced in the same manner as in Example 1 except that the compound represented by Formula (1) and the phosphorus compound were used in an amount of 0.7 part and 0.3 part, respectively. Evaluation was made similarly. The results are shown in Table 1.

Comparative Example 1

An electrophotographic photosensitive member was produced in the same manner as in Example 1 except that the compound represented by Formula (1) was replaced with a compound represented by the formula:

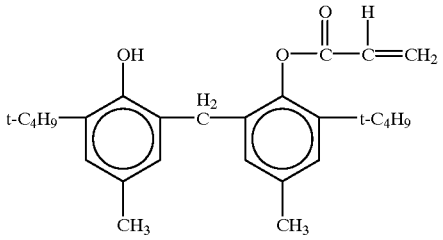

Evaluation was made similarly. The results are shown in Table 1.

Comparative Example 2

An electrophotographic photosensitive member was produced in the same manner as in Example 1 except that the compound represented by Formula (1) was replaced with a compound represented by the formula:

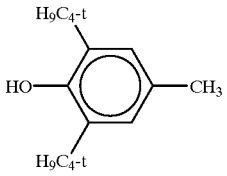

Evaluation was made similarly. The results are shown in Table 1.

Comparative Example 3

An electrophotographic photosensitive member was produced in the same manner as in Example 1 except that the compound represented by Formula (1) was not used. Evaluation was made similarly. The results are shown in Table 1.

TABLE 1

| | After 5,000 sheet running | |
|---|---|---|
| | Smeared image | Light-area potential variation (V) |
| Example: | | |
| 1 | A | 0 |
| 2 | A | 0 |
| 3 | A | 0 |
| 4 | A | +10 |
| 5 | A | +5 |
| 6 | A | −5 |
| 7 | A | +5 |
| Comparative Example: | | |
| 1 | B | +50 |
| 2 | C | −15 |
| 3 | B | −20 |

Remarks:
A: Not present.
B: Slightly present.
C: Present on the whole area.

(The same applies hereinafter.)

EXAMPLE 8

On an aluminum cylinder of 30 mm diameter and 346 mm long used as a support, an intermediate layer with a layer thickness of 1 μm was formed in the same manner as in Example 1.

Next, as a charge-generating material 10 parts of an azo pigment represented by the formula:

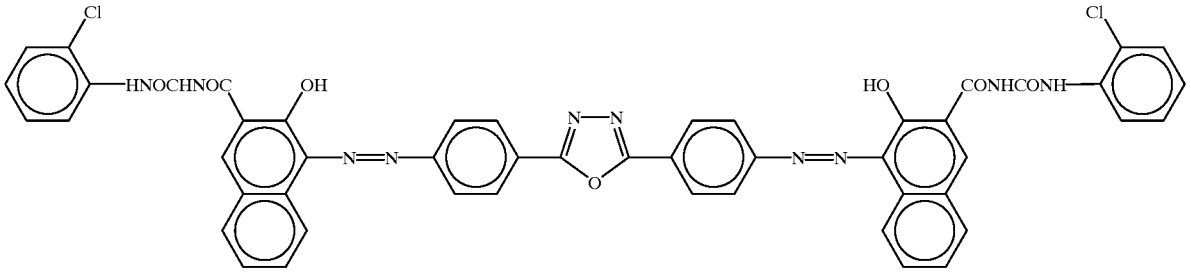

and also 6 parts of polyvinyl butyral (trade name: S-LEC BL-S; available from Sekisui Chemical Co., Ltd.) and 50 parts of cyclohexanone were dispersed for 4 hours by means of a sand grinder making use of glass beads of 1 mm diameter, followed by addition of 50 parts of tetrahydrofuran to obtain a charge generation layer coating fluid. This coating fluid was coated on the intermediate layer by dip coating, followed by drying to form a charge generation layer with a layer thickness of 0.2 $\mu$m.

Next, a charge transport layer with a layer thickness of 25 $\mu$m was formed in the same manner as in Example 1. Thus, an electrophotographic photosensitive member was produced.

Using the electrophotographic photosensitive member thus produced, a running test was made. As an apparatus used in the test, an electrophotographic copying machine NP-2020, manufactured by CANON INC., was used. In this test, the exhaust system was not operated at all. A running test to reproduce images continuously on 20,000 sheets was made in an environment of 32.5° C. and 85% RH to evaluate image quality and examine variations in light-area potential in the same manner as in Example 1. The results are shown in Table 2.

EXAMPLE 9

An electrophotographic photosensitive member was produced in the same manner as in Example 8 except that the charge-generating material was replaced with an azo pigment represented by the formula:

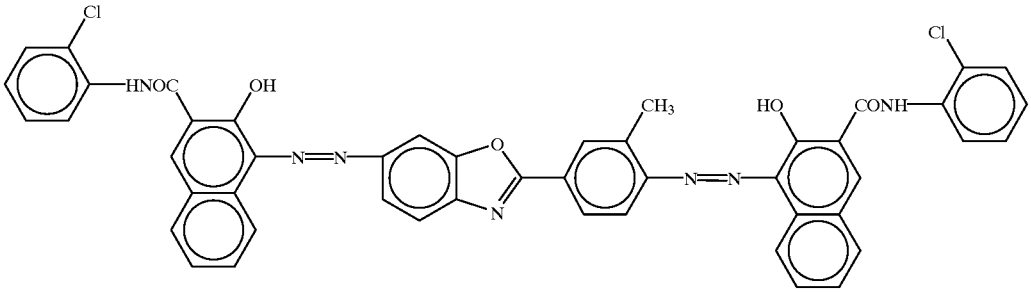

Evaluation was made similarly. The results are shown in Table 2.

EXAMPLE 10

An electrophotographic photosensitive member was produced in the same manner as in Example 8 except that the charge-generating material was replaced with an azo pigment represented by the formula:

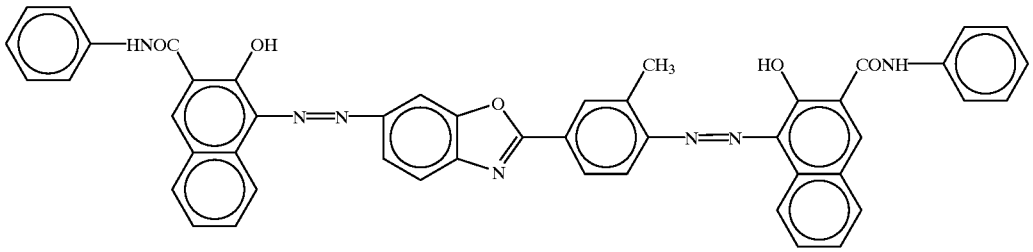

Evaluation was made similarly. The results are shown in Table 2.

EXAMPLE 11

An electrophotographic photosensitive member was produced in the same manner as in Example 8 except that the compound represented by Formula (1) and the phosphorus compound were used in an amount of 0.3 part and 0.7 part, respectively. Evaluation was made similarly. The results are shown in Table 2.

EXAMPLE 12

An electrophotographic photosensitive member was produced in the same manner as in Example 8 except that the compound represented by Formula (1) and the phosphorus compound were used in an amount of 0.7 part and 0.3 part, respectively. Evaluation was made similarly. The results are shown in Table 2.

Comparative Example 4

An electrophotographic photosensitive member was produced in the same manner as in Example 8 except that the compound represented by Formula (1) was replaced with a compound represented by the formula:

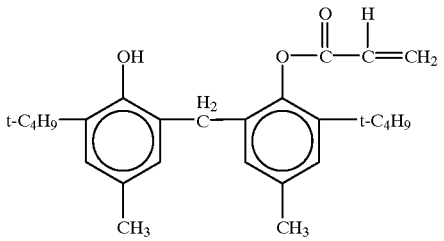

Evaluation was made similarly. The results are shown in Table 2.

Comparative Example 5

An electrophotographic photosensitive member was produced in the same manner as in Example 8 except that the compound represented by Formula (1) was replaced with a compound represented by the formula:

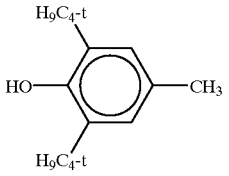

Evaluation was made similarly. The results are shown in Table 2.

Comparative Example 6

An electrophotographic photosensitive member was produced in the same manner as in Example 8 except that the compound represented by Formula (1) was not used. Evaluation was made similarly. The results are shown in Table 2.

TABLE 2

| | After 20,000 sheet running | |
|---|---|---|
| | Smeared image | Light-area potential variation (V) |
| Example: | | |
| 8 | A | +5 |
| 9 | A | 0 |
| 10 | A | −5 |
| 11 | A | +10 |
| 12 | A | +5 |
| Comparative Example: | | |
| 4 | C | +45 |
| 5 | C | −30 |
| 6 | B | −35 |

EXAMPLE 13

A conductive layer, an intermediate layer and a charge generation layer were formed successively on a support in the same manner as in Example 1 except that the charge-generating material was replaced with 5 parts of an azo pigment represented by the formula:

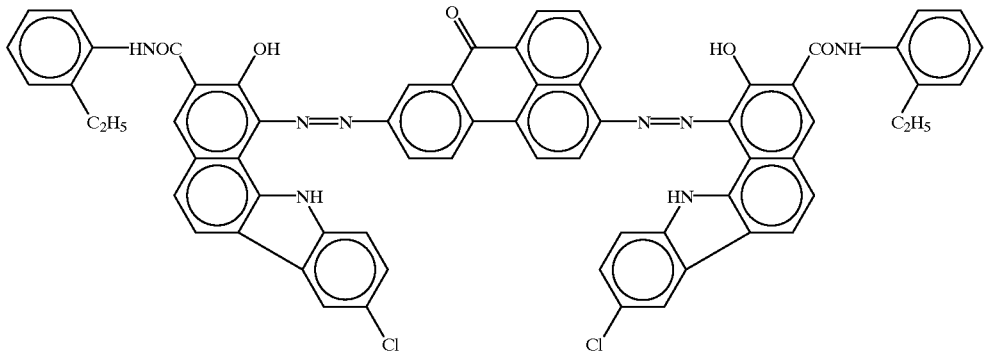

Next, a charge transport layer with a layer thickness of 20 μm was formed in the same manner as in Example 1 except that the two types of charge-transporting materials used therein were replaced with 10 parts of the exemplary triarylamine compound (4)-4. Thus, an electrophotographic photosensitive member was produced.

Using the electrophotographic photosensitive member thus produced, evaluation was made in the same manner as in Example 1. The results are shown in Table 3.

EXAMPLE 14

An electrophotographic photosensitive member was produced in the same manner as in Example 13 except that the triarylamine compound was replaced with the exemplary triarylamine compound (4)-7. Evaluation was made similarly. The results are shown in Table 3.

EXAMPLE 15

An electrophotographic photosensitive member was produced in the same manner as in Example 13 except that the triarylamine compound was replaced with the exemplary triarylamine compound (4)-12. Evaluation was made similarly. The results are shown in Table 3.

EXAMPLE 16

An electrophotographic photosensitive member was produced in the same manner as in Example 13 except that the triarylamine compound was replaced with the exemplary triarylamine compound (4)-22. Evaluation was made similarly. The results are shown in Table 3.

EXAMPLE 17

An electrophotographic photosensitive member was produced in the same manner as in Example 13 except that the triarylamine compound was replaced with the exemplary triarylamine compound (4)-30. Evaluation was made similarly. The results are shown in Table 3.

EXAMPLE 18

An electrophotographic photosensitive member was produced in the same manner as in Example 13 except that the triarylamine compound was replaced with the exemplary triarylamine compound (4)-48. Evaluation was made similarly. The results are shown in Table 3.

EXAMPLE 19

An electrophotographic photosensitive member was produced in the same manner as in Example 13 except that the triarylamine compound was replaced with the exemplary triarylamine compound (4)-63. Evaluation was made similarly. The results are shown in Table 3.

EXAMPLE 20

An electrophotographic photosensitive member was produced in the same manner as in Example 13 except that the compound represented by Formula (1) and the phosphorus compound were used in an amount of 0.3 part and 0.7 part, respectively. Evaluation was made similarly. The results are shown in Table 3.

EXAMPLE 21

An electrophotographic photosensitive member was produced in the same manner as in Example 13 except that the compound represented by Formula (1) and the phosphorus compound were used in an amount of 0.7 part and 0.3 part, respectively. Evaluation was made similarly. The results are shown in Table 3.

Comparative Example 7

An electrophotographic photosensitive member was produced in the same manner as in Example 13 except that the compound represented by Formula (1) was replaced with a compound represented by the formula:

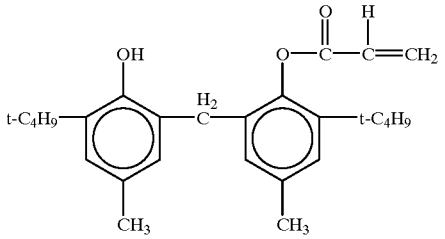

Evaluation was made similarly. The results are shown in Table 3.

Comparative Example 8

An electrophotographic photosensitive member was produced in the same manner as in Example 13 except that the compound represented by Formula (1) was replaced with a compound represented by the formula:

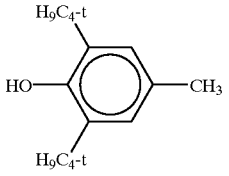

Evaluation was made similarly. The results are shown in Table 3.

Comparative Example 9

An electrophotographic photosensitive member was produced in the same manner as in Example 13 except that the compound represented by Formula (1) was not used. Evaluation was made similarly. The results are shown in Table 3.

TABLE 3

| | After 5,000 sheet running | |
|---|---|---|
| | Smeared image | Light-area potential variation (V) |
| Example: | | |
| 13 | A | 0 |
| 14 | A | −5 |
| 15 | A | 0 |
| 16 | A | −10 |
| 17 | A | +5 |
| 18 | A | +10 |
| 19 | A | +5 |
| 20 | A | −5 |
| 21 | A | +5 |

TABLE 3-continued

| | After 5,000 sheet running | |
|---|---|---|
| | Smeared image | Light-area potential variation (V) |
| Comparative Example: | | |
| 7 | B | +45 |
| 8 | C | −20 |
| 9 | B | −25 |

EXAMPLE 22

The procedure of Example 8 was repeated until the charge generation layer was formed.

Next, a charge transport layer was formed in the same manner as in Example 13 except that the charge-transporting material was replaced with the exemplary triarylamine compound (4)-8. Thus, an electrophotographic photosensitive member was produced.

On the electrophotographic photosensitive member thus produced, evaluation was made in the same manner as in Example 8. The results are shown in Table 4.

EXAMPLE 23

An electrophotographic photosensitive member was produced in the same manner as in Example 22 except that the triarylamine compound was replaced with the exemplary triarylamine compound (4)-22. Evaluation was made similarly. The results are shown in Table 4.

EXAMPLE 24

An electrophotographic photosensitive member was produced in the same manner as in Example 22 except that the triarylamine compound was replaced with the exemplary triarylamine compound (4)-46. Evaluation was made similarly. The results are shown in Table 4.

EXAMPLE 25

An electrophotographic photosensitive member was produced in the same manner as in Example 22 except that the triarylamine compound was replaced with the exemplary triarylamine compound (4)-61. Evaluation was made similarly. The results are shown in Table 4.

EXAMPLE 26

An electrophotographic photosensitive member was produced in the same manner as in Example 22 except that the compound represented by Formula (1) and the phosphorus compound were used in an amount of 0.3 part and 0.7 part, respectively. Evaluation was made similarly. The results are shown in Table 4.

EXAMPLE 27

An electrophotographic photosensitive member was produced in the same manner as in Example 22 except that the compound represented by Formula (1) and the phosphorus compound were used in an amount of 0.7 part and 0.3 part, respectively. Evaluation was made similarly. The results are shown in Table 4.

Comparative Example 10

An electrophotographic photosensitive member was produced in the same manner as in Example 22 except that the compound represented by Formula (1) was replaced with a compound represented by the formula:

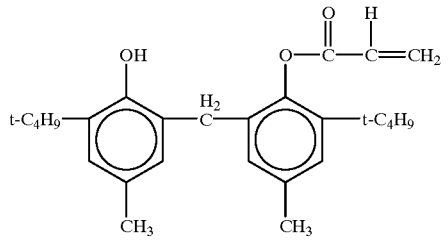

Evaluation was made similarly. The results are shown in Table 4.

Comparative Example 11

An electrophotographic photosensitive member was produced in the same manner as in Example 22 except that the compound represented by Formula (1) was replaced with a compound represented by the formula:

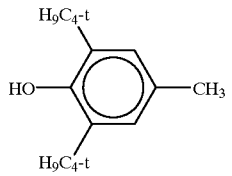

Evaluation was made similarly. The results are shown in Table 4.

Comparative Example 12

An electrophotographic photosensitive member was produced in the same manner as in Example 22 except that the compound represented by Formula (1) was not used. Evaluation was made similarly. The results are shown in Table 4.

TABLE 4

| | After 20,000 sheet running | |
|---|---|---|
| | Smeared image | Light-area potential variation (V) |
| Example: | | |
| 22 | A | 0 |
| 23 | A | +5 |
| 24 | A | −10 |
| 25 | A | 0 |
| 26 | A | −5 |
| 27 | A | +5 |
| Comparative Example: | | |
| 10 | C | +50 |
| 11 | B | −35 |
| 12 | C | +5 |

EXAMPLE 28

An electrophotographic photosensitive member was produced in the same manner as in Example 13 except that the triarylamine compound was replaced with the exemplary styryl compound (3)-5.

On the electrophotographic photosensitive member thus produced, evaluation was made in the same manner as in Example 1.

The results are shown in Table 5.

EXAMPLE 29

An electrophotographic photosensitive member was produced in the same manner as in Example 28 except that the styryl compound was replaced with the exemplary styryl compound (3)-8. Evaluation was made similarly. The results are shown in Table 5.

EXAMPLE 30

An electrophotographic photosensitive member was produced in the same manner as in Example 28 except that the styryl compound was replaced with the exemplary styryl compound (3)-10. Evaluation was made similarly. The results are shown in Table 5.

EXAMPLE 31

An electrophotographic photosensitive member was produced in the same manner as in Example 28 except that the styryl compound was replaced with the exemplary styryl compound (3)-14. Evaluation was made similarly. The results are shown in Table 5.

EXAMPLE 32

An electrophotographic photosensitive member was produced in the same manner as in Example 28 except that the styryl compound was replaced with the exemplary styryl compound (3)-21. Evaluation was made similarly. The results are shown in Table 5.

EXAMPLE 33

An electrophotographic photosensitive member was produced in the same manner as in Example 28 except that the styryl compound was replaced with the exemplary styryl compound (3)-27. Evaluation was made similarly. The results are shown in Table 5.

EXAMPLE 34

An electrophotographic photosensitive member was produced in the same manner as in Example 28 except that the styryl compound was replaced with the exemplary styryl compound (3)-33. Evaluation was made similarly. The results are shown in Table 5.

EXAMPLE 35

An electrophotographic photosensitive member was produced in the same manner as in Example 28 except that the compound represented by Formula (1) and the phosphorus compound were used in an amount of 0.3 part and 0.7 part, respectively. Evaluation was made similarly. The results are shown in Table 5.

EXAMPLE 36

An electrophotographic photosensitive member was produced in the same manner as in Example 28 except that the compound represented by Formula (1) and the phosphorus compound were used in an amount of 0.7 part and 0.3 part, respectively. Evaluation was made similarly. The results are shown in Table 5.

Comparative Example 13

An electrophotographic photosensitive member was produced in the same manner as in Example 28 except that the compound represented by Formula (1) was replaced with a compound represented by the formula:

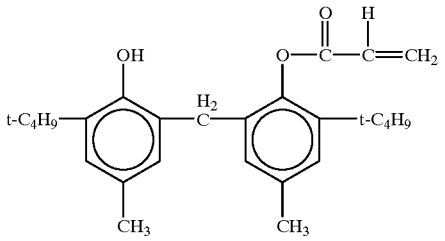

Evaluation was made similarly. The results are shown in Table 5.

Comparative Example 14

An electrophotographic photosensitive member was produced in the same manner as in Example 28 except that the compound represented by Formula (1) was replaced with a compound represented by the formula:

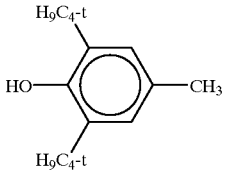

Evaluation was made similarly. The results are shown in Table 5.

Comparative Example 15

An electrophotographic photosensitive member was produced in the same manner as in Example 28 except that the compound represented by Formula (1) was not used. Evaluation was made similarly. The results are shown in Table 5.

TABLE 5

| | After 5,000 sheet running | |
|---|---|---|
| | Smeared image | Light-area potential variation (V) |
| Example: | | |
| 28 | A | −10 |
| 29 | A | +5 |
| 30 | A | 0 |
| 31 | A | −5 |
| 32 | A | +10 |
| 33 | A | −5 |
| 34 | A | +5 |
| 35 | A | −5 |
| 36 | A | +5 |
| Comparative Example: | | |
| 13 | B | +45 |
| 14 | C | +25 |
| 15 | B | −35 |

EXAMPLE 37

An electrophotographic photosensitive member was produced in the same manner as in Example 22 except that the triarylamine compound was replaced with the exemplary styryl compound (3)-3.

On the electrophotographic photosensitive member thus produced, evaluation was made in the same manner as in Example 22. The results are shown in Table 6.

EXAMPLE 38

An electrophotographic photosensitive member was produced in the same manner as in Example 37 except that the styryl compound was replaced with the exemplary styryl compound (3)-11. Evaluation was made similarly. The results are shown in Table 6.

EXAMPLE 39

An electrophotographic photosensitive member was produced in the same manner as in Example 37 except that the styryl compound was replaced with the exemplary styryl compound (3)-22. Evaluation was made similarly. The results are shown in Table 6.

EXAMPLE 40

An electrophotographic photosensitive member was produced in the same manner as in Example 37 except that the styryl compound was replaced with the exemplary styryl compound (3)-31. Evaluation was made similarly. The results are shown in Table 6.

EXAMPLE 41

An electrophotographic photosensitive member was produced in the same manner as in Example 37 except that the compound represented by Formula (1) and the phosphorus compound were used in an amount of 0.3 part and 0.7 part, respectively. Evaluation was made similarly. The results are shown in Table 6.

EXAMPLE 42

An electrophotographic photosensitive member was produced in the same manner as in Example 37 except that the compound represented by Formula (1) and the phosphorus compound were used in an amount of 0.7 part and 0.3 part, respectively. Evaluation was made similarly. The results are shown in Table 6.

Comparative Example 16

An electrophotographic photosensitive member was produced in the same manner as in Example 37 except that the compound represented by Formula (1) was replaced with a compound represented by the formula:

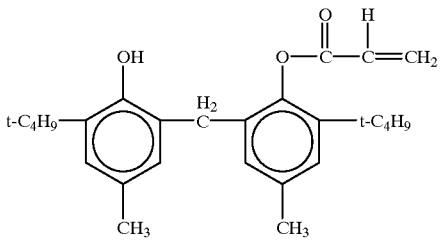

Evaluation was made similarly. The results are shown in Table 6.

Comparative Example 17

An electrophotographic photosensitive member was produced in the same manner as in Example 37 except that the compound represented by Formula (1) was replaced with a compound represented by the formula:

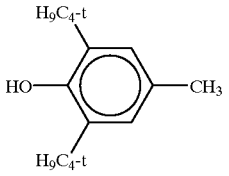

Evaluation was made similarly. The results are shown in Table 6.

Comparative Example 18

An electrophotographic photosensitive member was produced in the same manner as in Example 37 except that the compound represented by Formula (1) was not used. Evaluation was made similarly. The results are shown in Table 6.

TABLE 6

| | After 20,000 sheet running | |
|---|---|---|
| | Smeared image | Light-area potential variation (V) |
| Example: | | |
| 37 | A | 0 |
| 38 | A | +5 |
| 39 | A | −10 |
| 40 | A | −5 |
| 41 | A | −5 |
| 42 | A | +5 |
| Comparative Example: | | |
| 16 | C | +40 |
| 17 | B | −35 |
| 18 | C | +5 |

EXAMPLE 43

An electrophotographic photosensitive member was produced in the same manner as in Example 1 except that the charge-transporting material was replaced with 9 parts of a triarylamine compound represented by the formula:

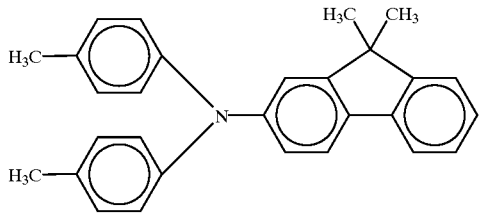

and 1 part of a styryl compound represented by the formula:

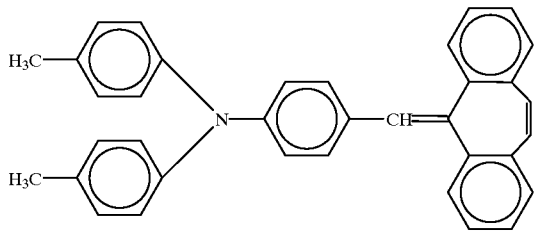

Evaluation was made similarly. As the result, no smeared images occurred and the variation of light-area potential was −5 V.

EXAMPLES 44 TO 48 & Comparative Examples 19 to 21

Electrophotographic photosensitive members were produced in the same manner as in Examples 1 to 5 and Comparative Examples 1 to 3, respectively, except that the phosphorus compound was not used and the compound represented by Formula (1) was used in an amount of 1 part. Evaluation was made similarly. The results are shown in Table 7.

TABLE 7

| | After: | | | |
|---|---|---|---|---|
| | 2,000 sheet running | | 5,000 sheet running | |
| | Smeared image | Light-area potential variation (V) | Smeared image | Light-area potential variation (V) |
| Example: | | | | |
| 44 | A | 0 | A | +5 |
| 45 | A | −5 | A | −10 |
| 46 | A | 0 | A | +5 |
| 47 | A | +5 | A | +10 |
| 48 | A | −5 | A | −10 |
| Comparative Example: | | | | |
| 19 | B | +40 | C | +45 |
| 20 | C | −25 | C | −35 |
| 21 | C | 0 | C | −10 |

EXAMPLES 49 TO 51 and Comparative Examples 22 to 24

Electrophotographic photosensitive members were produced in the same manner as in Examples 8 to 10 and Comparative Examples 4 to 6, respectively, except that the phosphorus compound was not used and the compound represented by Formula (1) was used in an amount of 1 part. Evaluation was made similarly. The results are shown in Table 8.

TABLE 8

| | After: | | | |
|---|---|---|---|---|
| | 10,000 sheet running | | 20,000 sheet running | |
| | Smeared image | Light-area potential variation (V) | Smeared image | Light-area potential variation (V) |
| Example: | | | | |
| 49 | A | +5 | A | +5 |
| 50 | A | 0 | A | −5 |
| 51 | A | −5 | A | −10 |
| Comparative Example: | | | | |
| 22 | C | +45 | C | +50 |
| 23 | C | −30 | C | −40 |
| 24 | C | −5 | C | −20 |

EXAMPLES 52 TO 58 & Comparative Examples 25 to 27

Electrophotographic photosensitive members were produced in the same manner as in Examples 28 to 34 and Comparative Examples 13 to 15, respectively, except that the phosphorus compound was not used, the compound represented by Formula (1) was used in an amount of 1 part and the charge transport layer was formed in a layer thickness of 21 $\mu$m. Evaluation was made similarly.

The results are shown in Table 9.

TABLE 9

| | After: | | | |
|---|---|---|---|---|
| | 2,000 sheet running | | 5,000 sheet running | |
| | Smeared image | Light-area potential variation (V) | Smeared image | Light-area potential variation (V) |
| Example: | | | | |
| 52 | A | −5 | A | −10 |
| 53 | A | +5 | A | +5 |
| 54 | A | 0 | A | +5 |
| 55 | A | −10 | A | −10 |
| 56 | A | +5 | A | +10 |
| 57 | A | −10 | A | −10 |
| 58 | A | +5 | A | +5 |
| Comparative Example: | | | | |
| 25 | B | +40 | C | +60 |
| 26 | C | +25 | C | +30 |
| 27 | C | −5 | C | −20 |

EXAMPLES 59 TO 62

Electrophotographic photosensitive members were produced in the same manner as in Examples 37 to 40, respectively, except that the phosphorus compound was not used and the compound represented by Formula (1) was used in an amount of 1 part. Evaluation was made similarly. The results are shown in Table 10.

EXAMPLE 63

An electrophotographic photosensitive member was produced in the same manner as in Example 59 except that the styryl compound was replaced with the exemplary styryl compound (3)-37. Evaluation was made similarly. The results are shown in Table 10.

Comparative Examples 28 to 30

Electrophotographic photosensitive members were produced in the same manner as in Comparative Examples 16 to 18, respectively, except that the phosphorus compound was not used and the compound represented by Formula (1) was used in an amount of 1 part. Evaluation was made similarly. The results are shown in Table 10.

TABLE 10

| | After: | | | |
|---|---|---|---|---|
| | 10,000 sheet running | | 20,000 sheet running | |
| | Smeared image | Light-area potential variation (V) | Smeared image | Light-area potential variation (V) |
| Example: | | | | |
| 59 | A | +5 | A | +5 |
| 60 | A | 0 | A | +5 |
| 61 | A | −10 | A | −10 |
| 62 | A | −5 | A | −10 |
| 63 | A | 0 | A | +5 |
| Comparative Example: | | | | |
| 28 | C | +30 | C | +45 |
| 29 | C | −50 | C | −60 |
| 30 | C | −5 | C | −20 |

EXAMPLE 64

An electrophotographic photosensitive member was produced in the same manner as in Example 52 except that the styryl compound was replaced with the exemplary triarylamine compound (4)-5. Evaluation was made similarly.

The results are shown in Table 11.

EXAMPLE 65

An electrophotographic photosensitive member was produced in the same manner as in Example 64 except that the triarylamine compound was replaced with the exemplary triarylamine compound (4)-9. Evaluation was made similarly.

The results are shown in Table 11.

EXAMPLE 66

An electrophotographic photosensitive member was produced in the same manner as in Example 64 except that the triarylamine compound was replaced with the exemplary triarylamine compound (4)-11. Evaluation was made similarly.

The results are shown in Table 11.

EXAMPLE 67

An electrophotographic photosensitive member was produced in the same manner as in Example 64 except that the triarylamine compound was replaced with the exemplary triarylamine compound (4)-20. Evaluation was made similarly.

The results are shown in Table 11.

EXAMPLE 68

An electrophotographic photosensitive member was produced in the same manner as in Example 64 except that the triarylamine compound was replaced with the exemplary triarylamine compound (4)-39. Evaluation was made similarly.

The results are shown in Table 11.

EXAMPLE 69

An electrophotographic photosensitive member was produced in the same manner as in Example 64 except that the triarylamine compound was replaced with the exemplary triarylamine compound (4)-47. Evaluation was made similarly.

The results are shown in Table 11.

EXAMPLE 70

An electrophotographic photosensitive member was produced in the same manner as in Example 64 except that the triarylamine compound was replaced with the exemplary triarylamine compound (4)-60. Evaluation was made similarly.

The results are shown in Table 11.

Comparative Examples 31 to 33

Electrophotographic photosensitive members were produced in the same manner as in Comparative Examples 25 to 27, respectively, except that the styryl compound was replaced with the exemplary triarylamine compound (4)-5. Evaluation was made similarly. The results are shown in Table 11.

TABLE 11

| | After: | | | |
|---|---|---|---|---|
| | 2,000 sheet running | | 5,000 sheet running | |
| | Smeared image | Light-area potential variation (V) | Smeared image | Light-area potential variation (V) |
| Example: | | | | |
| 64 | A | +5 | A | +5 |
| 65 | A | −5 | A | −10 |
| 66 | A | 0 | A | +5 |
| 67 | A | +10 | A | +15 |
| 68 | A | −5 | A | −5 |
| 69 | A | −10 | A | −10 |
| 70 | A | +5 | A | +10 |
| Comparative Example: | | | | |
| 31 | B | +40 | C | +50 |
| 32 | C | −25 | C | −30 |
| 33 | C | +5 | C | +10 |

EXAMPLE 71

An electrophotographic photosensitive member was produced in the same manner as in Example 59 except that the styryl compound was replaced with the exemplary triarylamine compound (4)-8. Evaluation was made similarly. The results are shown in Table 12.

EXAMPLE 72

An electrophotographic photosensitive member was produced in the same manner as in Example 71 except that the triarylamine compound was replaced with the exemplary triarylamine compound (4)-27. Evaluation was made similarly. The results are shown in Table 12.

EXAMPLE 73

An electrophotographic photosensitive member was produced in the same manner as in Example 71 except that the triarylamine compound was replaced with the exemplary triarylamine compound (4)-43. Evaluation was made similarly. The results are shown in Table 12.

EXAMPLE 74

An electrophotographic photosensitive member was produced in the same manner as in Example 71 except that the triarylamine compound was replaced with the exemplary triarylamine compound (4)-58. Evaluation was made similarly. The results are shown in Table 12.

EXAMPLE 75

An electrophotographic photosensitive member was produced in the same manner as in Example 71 except that the triarylamine compound was replaced with the exemplary triarylamine compound (4)-69. Evaluation was made similarly. The results are shown in Table 12.

Comparative Examples 34 to 36

Electrophotographic photosensitive members were produced in the same manner as in Comparative Examples 28 to 30, respectively, except that the styryl compound was replaced with the exemplary triarylamine compound (4)-8. Evaluation was made similarly. The results are shown in Table 12.

TABLE 12

| | After: | | | |
|---|---|---|---|---|
| | 10,000 sheet running | | 20,000 sheet running | |
| | Smeared image | Light-area potential variation (V) | Smeared image | Light-area potential variation (V) |
| Example: | | | | |
| 71 | A | −5 | A | −5 |
| 72 | A | 0 | A | +5 |
| 73 | A | +10 | A | +10 |
| 74 | A | +5 | A | +10 |
| 75 | A | 0 | A | +5 |
| Comparative Example: | | | | |
| 34 | C | −30 | C | −50 |
| 35 | C | +50 | C | +55 |
| 36 | C | −5 | C | −30 |

EXAMPLE 76

An electrophotographic photosensitive member was produced in the same manner as in Example 52 except that the styryl compound was replaced with the exemplary hydrazone compound (5)-3. Evaluation was made similarly. The results are shown in Table 13.

EXAMPLE 77

An electrophotographic photosensitive member was produced in the same manner as in Example 76 except that the hydrazone compound was replaced with the exemplary hydrazone compound (5)-6. Evaluation was made similarly. The results are shown in Table 13.

EXAMPLE 78

An electrophotographic photosensitive member was produced in the same manner as in Example 76 except that the hydrazone compound was replaced with the exemplary hydrazone compound (5)-12. Evaluation was made similarly. The results are shown in Table 13.

EXAMPLE 79

An electrophotographic photosensitive member was produced in the same manner as in Example 76 except that the hydrazone compound was replaced with the exemplary hydrazone compound (5)-17. Evaluation was made similarly. The results are shown in Table 13.

EXAMPLE 80

An electrophotographic photosensitive member was produced in the same manner as in Example 76 except that the hydrazone compound was replaced with the exemplary hydrazone compound (5)-23. Evaluation was made similarly. The results are shown in Table 13.

EXAMPLE 81

An electrophotographic photosensitive member was produced in the same manner as in Example 76 except that the hydrazone compound was replaced with the exemplary hydrazone compound (5)-35. Evaluation was made similarly. The results are shown in Table 13.

EXAMPLE 82

An electrophotographic photosensitive member was produced in the same manner as in Example 76 except that the hydrazone compound was replaced with the exemplary hydrazone compound (5)-44. Evaluation was made similarly. The results are shown in Table 13.

Comparative Examples 37 to 39

Electrophotographic photosensitive members were produced in the same manner as in Comparative Examples 25 to 27, respectively, except that the styryl compound was replaced with the exemplary hydrazone compound (5)-3. Evaluation was made similarly. The results are shown in Table 13.

TABLE 13

| | After: | | | |
|---|---|---|---|---|
| | 2,000 sheet running | | 5,000 sheet running | |
| | Smeared image | Light-area potential variation (V) | Smeared image | Light-area potential variation (V) |
| Example: | | | | |
| 76 | A | 0 | A | +5 |
| 77 | A | +5 | A | +10 |
| 78 | A | −2 | A | −5 |
| 79 | A | 0 | A | 0 |
| 80 | A | +10 | A | +10 |
| 81 | A | −3 | A | −5 |
| 82 | A | −5 | A | −10 |

TABLE 13-continued

| | After: | | | |
|---|---|---|---|---|
| | 2,000 sheet running | | 5,000 sheet running | |
| | Smeared image | Light-area potential variation (V) | Smeared image | Light-area potential variation (V) |
| Comparative Example: | | | | |
| 37 | C | +28 | C | +35 |
| 38 | B | −45 | C | −60 |
| 39 | C | −10 | C | −30 |

EXAMPLE 83

An electrophotographic photosensitive member was produced in the same manner as in Example 59 except that the styryl compound was replaced with the exemplary hydrazone compound (5)-10. Evaluation was made similarly. The results are shown in Table 14.

EXAMPLE 84

An electrophotographic photosensitive member was produced in the same manner as in Example 83 except that the hydrazone compound was replaced with the exemplary hydrazone compound (5)-14. Evaluation was made similarly. The results are shown in Table 14.

EXAMPLE 85

An electrophotographic photosensitive member was produced in the same manner as in Example 83 except that the hydrazone compound was replaced with the exemplary hydrazone compound (5)-20. Evaluation was made similarly. The results are shown in Table 14.

EXAMPLE 86

An electrophotographic photosensitive member was produced in the same manner as in Example 83 except that the hydrazone compound was replaced with the exemplary hydrazone compound (5)-25. Evaluation was made similarly. The results are shown in Table 14.

EXAMPLE 87

An electrophotographic photosensitive member was produced in the same manner as in Example 83 except that the hydrazone compound was replaced with the exemplary hydrazone compound (5)-33. Evaluation was made similarly. The results are shown in Table 14.

Comparative Examples 40 to 42

Electrophotographic photosensitive members were produced in the same manner as in Comparative Examples 28 to 30, respectively, except that the styryl compound was replaced with the exemplary hydrazone compound (5)-10. Evaluation was made similarly. The results are shown in Table 14.

TABLE 14

| | After: | | | |
|---|---|---|---|---|
| | 10,000 sheet running | | 20,000 sheet running | |
| | Smeared image | Light-area potential variation (V) | Smeared image | Light-area potential variation (V) |
| Example: | | | | |
| 83 | A | 0 | A | 0 |
| 84 | A | +4 | A | +10 |
| 85 | A | +7 | A | +15 |
| 86 | A | −10 | A | −15 |
| 87 | A | −5 | A | −10 |
| Comparative Example: | | | | |
| 40 | C | +45 | C | +60 |
| 41 | C | −27 | C | −40 |
| 42 | C | +4 | C | +20 |

EXAMPLE 88

An electrophotographic photosensitive member was produced in the same manner as in Example 44 except that the charge-transporting material was replaced with 9 parts of a triarylamine compound represented by the formula:

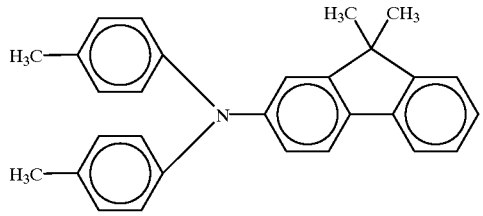

and 1 part of a styryl compound represented by the formula:

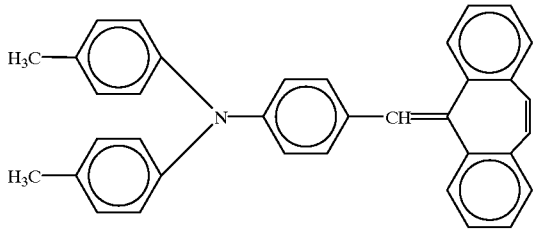

Evaluation was made similarly. As the result, no smeared images occurred both after 2,000 sheet running and after 5,000 sheet running, and the variation of light-area potential after 2,000 sheet running was +3 V and the variation of light-area potential after 5,000 sheet running was +10 V.

EXAMPLES 89 AND 90

Electrophotographic photosensitive members were produced in the same manner as in Example 43, except that the compound represented by the formula (1) was replaced with the exemplary compounds (1)-1 and (1)-4, respectively. Evaluation was made similarly. The results are shown in Table 15.

EXAMPLES 91 AND 92

Electrophotographic photosensitive members were produced in the same manner as in Example 43, except that the phosphorus compound represented by the formula (2) was replaced with the exemplary compounds (2)-3 and (2)-10, respectively. Evaluation was made similarly. The results are shown in Table 15.

EXAMPLE 93

An electrophotographic photosensitive member was produced in the same manner as in Example 43, except that the compound represented by the formula (1) was replaced by the exemplary compound (1)-4 and the phosphorus compound represented by the formula (2) was replaced with the exemplary phosphorus compound (2)-10. Evaluation was made similarly. The results are shown in Table 15.

EXAMPLE 94

An electrophotographic photosensitive member was produced in the same manner as in Example 43, except that the compound represented by the formula (1) was replaced by the exemplary compound (1)-10 and the phosphorus compound represented by the formula (2) was replaced with the exemplary phosphorus compound (2)-3. Evaluation was made similarly. The results are shown in Table 15.

EXAMPLES 95 TO 97

Electrophotographic photosensitive members were produced in the same manner as in Example 88, except that the compound represented by the formula (1) was replaced with the exemplary compounds (1)-1, (1)-4 and (1)-10, respectively. Evaluation was made similarly.

The results are shown in Table 15.

TABLE 15

| | After 5,000 sheet running | |
|---|---|---|
| Example: | Smeared image | Light-area potential variation (V) |
| 89 | A | −7 |
| 90 | A | −5 |
| 91 | A | +8 |
| 92 | A | +5 |
| 93 | A | −7 |
| 94 | A | −10 |
| 95 | A | +15 |
| 96 | A | +10 |
| 97 | A | +10 |

What is claimed is:

1. An electrophotographic photosensitive member comprising a support and a photosensitive layer provided on the support; said photosensitive layer containing:

(a) a compound which is represented by the following Formula (1):

(1)

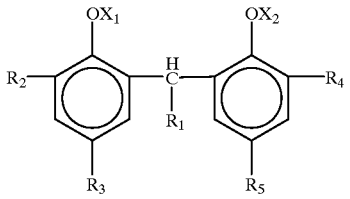

wherein $R_1$ represents an alkyl group or an alkenyl group; $R_2$, $R_3$ $R_4$ and $R_5$ are the same or different and each represent a hydrogen atom, an alkyl group or an alkenyl group; and $X_1$ and $X_2$ are the same or different and each represent a hydrogen atom, an alkyl group, an alkenyl group or an acryloyl group, provided that $X_1$ and $X_2$ are not hydrogen atoms at the same time; and (b) a phosphorus compound represented by the following Formula (2):

(2)

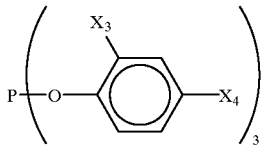

wherein $X_3$ and $X_4$ represent an alkyl group or an alkenyl group.

2. The electrophotographic photosensitive member according to claim 1, wherein said compound represented by Formula (1) has the following structure:

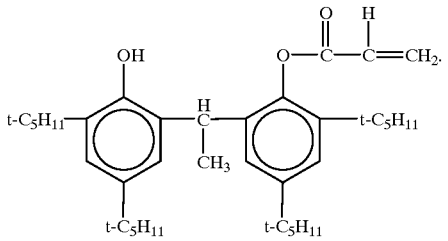

3. The electrophotographic photosensitive member according to claim 1, wherein said phosphorus compound represented by Formula (2) has the following structure:

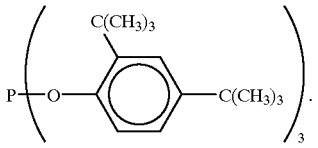

4. The ectrophotographic photosensitive member according to claim 1 wherein said compound (a) represented by Formula (1) and said phosphorus compound (b) represented by Formula (2) have the following structure, respectively:

(a

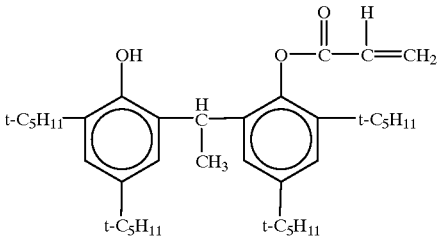

-continued (b)

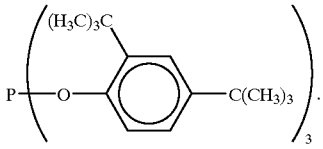

5. The electrophotographic photosensitive member according to claim 1, wherein said photosensitive layer contains a charge-transporting material, and the charge-transporting material is represented by the formula selected from the group consisting of the following Formulas (3) to (5):

(3)

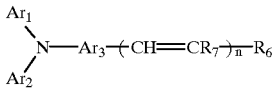

wherein $Ar_1$ and $Ar_2$ each represent an aromatic hydrocarbon ring group; $Ar_3$ represents a divalent aromatic hydrocarbon ring group or a divalent heterocyclic group; $R_6$ represents an alkyl group or an aromatic hydrocarbon ring group; $R_7$ represents a hydrogen atom, an alkyl group or an aromatic hydrocarbon ring group; n is 1 or 2; and $R_6$ and $R_7$ may combine to form a ring when n is 1, (4)

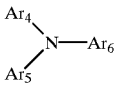

wherein $Ar_4$, $Ar_5$ and $Ar_6$ each represent an aromatic hydrocarbon ring group or a heterocyclic group, (5)

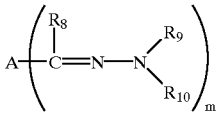

wherein $R_8$ represents a hydrogen atom or an alkyl group; $R_9$ and $R_{10}$ each represent an alkyl group or an aromatic hydrocarbon ring group; m is 1 or 2; and A represents an aromatic hydrocarbon ring group, a heterocyclic group or —CH=C($R_{11}$)$R_{12}$, where $R_{11}$ and $R_{12}$ each represent a hydrogen atom, an aromatic hydrocarbon ring group or a heterocyclic group, provided that $R_1$l and $R_{12}$ are not hydrogen atoms at the same time.

6. The electrophotographic photosensitive member according to claim 5, wherein said charge-transporting material is represented by Formula (3).

7. The electrophotographic photosensitive member according to claim 5, wherein said charge-transporting material is represented by Formula (4).

8. The electrophotographic photosensitive member according to claim 5, wherein said charge-transporting material is represented by Formula (5).

9. A process cartridge comprising an electrophotographic photosensitive member and at least one means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a support and a photosensitive layer provided on the support;

said photosensitive layer containing (a) a compound which is represented by the following Formula (1):

(1)

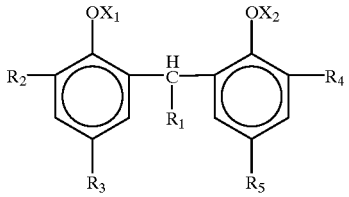

wherein $R_1$ represents an alkyl group or an alkenyl group; $R_2$, $R_3$, $R_4$ and $R_4$ are the same or different and each represent a hydrogen atom, an alkyl group or an alkenyl group; and $X_1$ and $X_2$ are the same or different and each represent a hydrogen atom, an alkyl group, an alkenyl group or an acryloyl group, provided that $X_1$ and $X_2$ are not hydrogen atoms at the same time; and (b) a phosphorus compound represented by the following Formula (2):

(2)

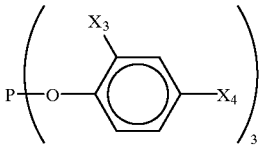

wherein $X_3$ and $X_4$ represent an alkyl group or an alkenyl group.

10. An electrophotographic apparatus comprising an electrophotographic photosensitive member, a charging means, an exposure means, a developing means and a transfer means;

said electrophotographic photosensitive member comprising a support and a photosensitive layer provided on the support; said photosensitive layer containing (a) a compound which is represented by the following Formula (1):

(1)

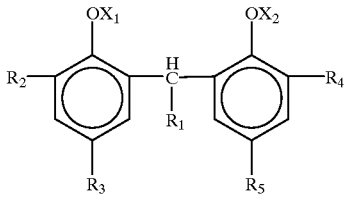

wherein $R_1$ represents an alkyl group or an alkenyl group; $R_2$, R3, $R_4$ and $R_5$ are the same or different and each represent a hydrogen atom, an alkyl group or an alkenyl group; and $X_1$ and $X_2$ are the same or different and each represent a hydrogen atom, an alkyl group, an alkenyl group or an acryloyl group, provided that $X_1$ and $X_2$ are not hydrogen atoms at the same time; and (b) a phosphorus compound represented by the following Formula (2):

(2)

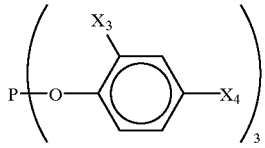

wherein $X_3$ and $X_4$ represent an alkyl group or an alkenyl group.

* * * * *

UNITED STATES PATENT AND TRADEMARK OFFICE

CERTIFICATE OF CORRECTION

PATENT NO. : 6,225,017 B1
DATED : May 1, 2001
INVENTOR(S) : Kazuma Sato et al.

It is certified that error appears in the above-identified patent and that said Letters Patent is hereby corrected as shown below:

Column 8,
Line 24, "25" should be deleted.

Column 35,
Exemplary Compound (5)-33, "$H_2C$" (both occurrences) should read -- $H_3C$ --.

Column 69,
Line 57, "$R_1 1$" should read -- $R_{11}$ --.

Column 71,
Line 13, "R3," should read -- $R_3$ --.

Signed and Sealed this

Twenty-sixth Day of March, 2002

*Attest:*

*Attesting Officer*

JAMES E. ROGAN
*Director of the United States Patent and Trademark Office*